US011371216B2

(12) United States Patent
Inaoka et al.

(10) Patent No.: US 11,371,216 B2
(45) Date of Patent: Jun. 28, 2022

(54) WORK VEHICLE

(71) Applicant: Kubota Corporation, Osaka (JP)

(72) Inventors: Masaki Inaoka, Sakai (JP); Yoshihiro Ebata, Sakai (JP); Shun Tsuruta, Sakai (JP); Daiki Abe, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/488,314

(22) Filed: Sep. 29, 2021

(65) Prior Publication Data

US 2022/0112689 A1 Apr. 14, 2022

(30) Foreign Application Priority Data

Oct. 12, 2020 (JP) ..... JP2020-171755

(51) Int. Cl.
*E02F 9/22* (2006.01)

(52) U.S. Cl.
CPC ..... *E02F 9/2292* (2013.01); *E02F 9/2246* (2013.01); *E02F 9/2253* (2013.01); *E02F 9/2285* (2013.01)

(58) Field of Classification Search
CPC .... E02F 9/2253; E02F 9/2292; F16H 61/433; F16H 61/438
See application file for complete search history.

(56) References Cited

U.S. PATENT DOCUMENTS

| | | | | |
|---|---|---|---|---|
| 9,316,310 | B2 * | 4/2016 | Kinugawa | F16H 61/468 |
| 10,316,496 | B2 * | 6/2019 | Fukuda | E02F 9/2228 |
| 10,648,489 | B2 * | 5/2020 | Fukuda | F16H 61/44 |
| 10,704,232 | B2 * | 7/2020 | Fukuda | E02F 9/226 |
| 10,767,346 | B2 * | 9/2020 | Honda | E02F 9/2289 |
| 10,787,787 | B2 * | 9/2020 | Abe | E02F 9/2267 |
| 11,001,990 | B2 * | 5/2021 | Fukuda | E02F 9/2292 |
| 11,236,491 | B2 * | 2/2022 | Fukuda | E02F 3/3414 |
| 2020/0024830 | A1 | 1/2020 | Honda et al. | |
| 2022/0049727 | A1 * | 2/2022 | Fukuda | F16H 61/431 |

FOREIGN PATENT DOCUMENTS

JP 2020-12350 1/2020

* cited by examiner

*Primary Examiner* — Michael Leslie
(74) *Attorney, Agent, or Firm* — Mori & Ward, LLP

(57) ABSTRACT

A work vehicle includes a first hydraulic pump that supplies hydraulic oil to a first hydraulic motor so as to drive a first travel device forward when hydraulic pressure applied to a first port is higher than hydraulic pressure applied to a second port, and a second hydraulic pump to drive a second travel device forward when hydraulic pressure applied to a third port is higher than hydraulic pressure applied to a fourth port. A first pilot oil passage, a second pilot oil passage, a third pilot oil passage, and a fourth pilot oil passage connect the operation device to first, second, third, and fourth ports, respectively. A first bypass oil passage connects the first pilot oil passage and the fourth pilot oil passage. A second bypass oil passage connects the second pilot oil passage and the third pilot oil passage. A first throttle is provided in the first bypass oil passage. A second throttle is provided in the second bypass oil passage.

11 Claims, 13 Drawing Sheets

WORK VEHICLE

CROSS-REFERENCE TO RELATED APPLICATIONS

The present application claims priority under 35 U. S. C. §119 to Japanese Patent Application No. 2020-171755, filed Oct. 12, 2020. The contents of this application are incorporated herein by reference in their entirety.

BACKGROUND

Technical Field

The present invention relates to a work vehicle.

Background Art

Japanese Patent Application Laid-Open No. 2020-012350 describes a hydraulic circuit that controls two hydraulic motors for traveling, which are disposed on left and right side surfaces of a work vehicle.

SUMMARY OF THE INVENTION

According to a first aspect of the present disclosure, a work vehicle includes a vehicle body, a first travel device, a second travel device, a first hydraulic motor, a second hydraulic motor, a first hydraulic pump, a second hydraulic pump, an operation device, a first pilot oil passage, a second pilot oil passage, a third pilot oil passage, a fourth pilot oil passage, a first bypass oil passage, a second bypass oil passage, a first throttle, and a second throttle. The vehicle body has a first side surface and a second side surface opposite to the first side surface. The first travel device is provided on the first side surface of the vehicle body. The second travel device is provided on the second side surface of the vehicle body. The first hydraulic motor is configured to drive the first travel device. The second hydraulic motor is configured to drive the second travel device. The first hydraulic pump is connected to the first hydraulic motor via a first hydraulic circuit. The first hydraulic pump has a first port and a second port. When the hydraulic pressure applied to the first port is higher than the hydraulic pressure applied to the second port, the first hydraulic pump supplies hydraulic oil to the first hydraulic motor via the first hydraulic circuit so as to drive the first travel device forward. The first hydraulic pump is configured to supply hydraulic oil to the first hydraulic motor via the first hydraulic circuit so as to drive the first travel device to move backward when the hydraulic pressure applied to the second port is higher than the hydraulic pressure applied to the first port. The second hydraulic pump is connected to the second hydraulic motor via a second hydraulic circuit. The second hydraulic pump has a third port and a fourth port. When the hydraulic pressure applied to the third port is higher than the hydraulic pressure applied to the fourth port, the second hydraulic pump supplies hydraulic oil to the second hydraulic motor via the second hydraulic circuit so as to drive the second travel device forward. The second hydraulic pump is configured to supply hydraulic oil to the second hydraulic motor via the second hydraulic circuit so as to drive the second travel device to move backward when the hydraulic pressure applied to the fourth port is higher than the hydraulic pressure applied to the third port. The operation device is configured to select at least one travel device out of the first travel device and the second travel device and to operate forward or backward movement of the at least one travel device. The first pilot oil passage connects the operation device and the first port. The second pilot oil passage connects the operation device and the second port. The third pilot oil passage connects the operation device and the third port. The fourth pilot oil passage connects the operation device and the fourth port. The first bypass oil passage connects the first pilot oil passage and the fourth pilot oil passage. The second bypass oil passage connects the second pilot oil passage and the third pilot oil passage. The first throttle is provided in the first bypass oil passage. The second throttle is provided in the second bypass oil passage. The first, second, third, and fourth pilot oil passages pass through an identical connector.

DESCRIPTION OF THE EMBODIMENTS

Figure 1:
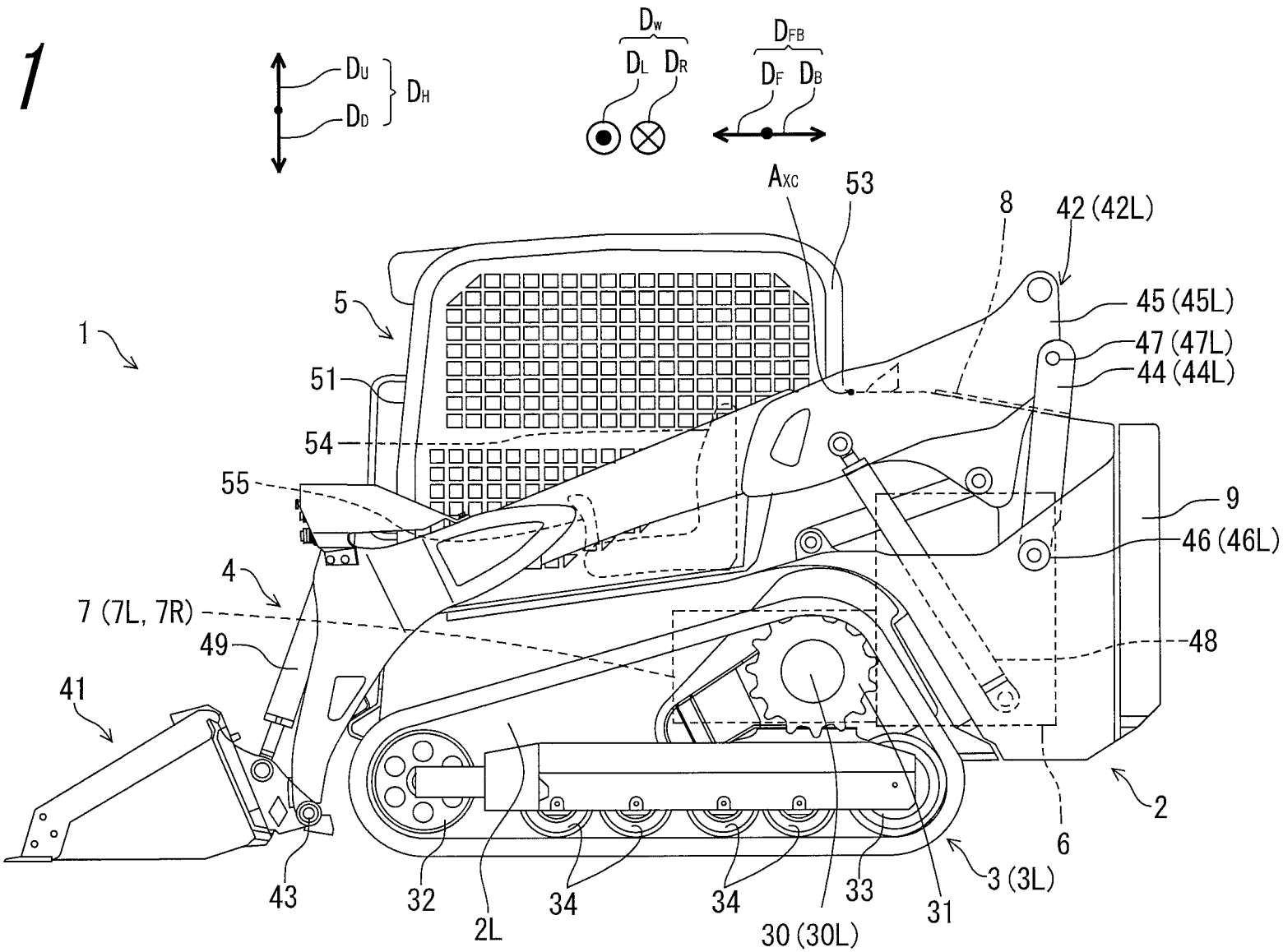
FIG. 1 is a side view of the work vehicle.

Hereinafter, the present invention will be described in detail with reference to the drawings showing embodiments thereof. In the drawings, the same reference numerals denote corresponding or substantially identical components.

EMBODIMENT

Overall Configuration

Figure 2:
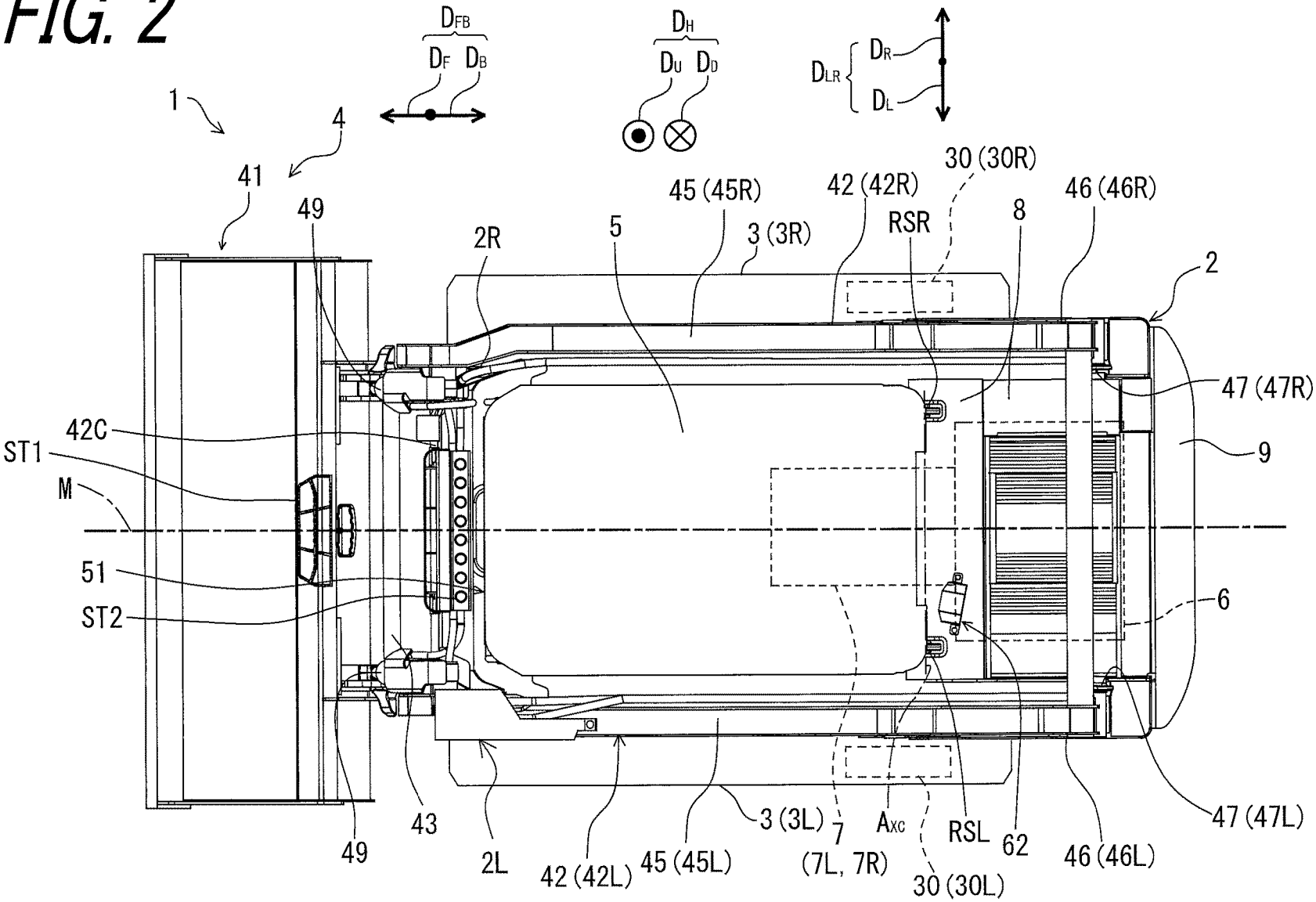
FIG. 2 is a top view of the work vehicle.

Referring to FIGS. 1 and 2, a work vehicle 1, for example, a compact truck loader includes a vehicle body 2, a pair of travel devices 3, and a work device 4. The vehicle body 2 supports the travel devices 3 and the work device 4. In the illustrated embodiment, the travel devices 3 are crawler-type travel devices. Thus, each of the pair of travel devices 3 includes a drive wheel 31 that are driven by the hydraulic motor devices 30, driven wheels 32 and 33, and track rollers 34. However, each of the pair of travel devices 3 is not limited to a crawler type travel device. Each of the pair of travel devices 3 may be, for example, a front wheel/rear wheel travel device or a travel device including a front wheel and a rear crawler. The work device 4 includes work equipment (bucket) 41 at a distal end of the work device 4. A proximal end of the work device 4 is attached to the rear of the vehicle body 2. The work device 4 includes a pair of arm mechanisms 42 to rotatably support the bucket 41 via a bucket pivot shaft 43. Each of the pair of arm mechanisms 42 includes a link 44 and an arm 45.

The link 44 is rotatable relative to the vehicle body 2 about a fulcrum shaft 46. The arm 45 is rotatable relative to the link 44 about a joint shaft 47. The work device 4 further includes a plurality of arm cylinders 48 and at least one equipment cylinder 49. Each of the plurality of arm cylinders 48 is rotatably connected to the vehicle body 2 and the arm 45, and moves the link 44, the arm 45, and the like to raise and lower the bucket 41. The at least one implement cylinder 49 is configured to tilt the bucket 41. The vehicle body 2 includes a cabin 5. The cabin 5 includes a front window 51 that can be opened and closed, and is defined by a cab frame 53. The front window 51 may be omitted. The work vehicle 1 includes an operator's seat 54 and an operation lever 55 in a cabin 5. The cab frame 53 is rotatable about rotational shafts RSL and RSR on the vehicle body 2, as shown in FIG. 2. FIGS. 1 and 2 illustrate a common pivot Axc defined by the pivot axes RSL and RSR. That is, the cab frame 53 is attached to the vehicle body 2 so as to be rotatable about the pivot Axc.

In the embodiment according to the present application, the front-rear direction $D_{FB}$ (front direction $D_F$ /rear direction $D_B$) means a front-rear direction (front direction/rear direction) as viewed from an operator seated in the operator's seat 54 of the cabin 5. The left direction $D_L$, the right direction $D_R$, and the width direction $D_W$ respectively mean a left direction, a right direction, and a left and right direction as viewed from the operator. The upward direction $D_U$, the downward direction $D_D$, and the height direction $D_H$ mean an upward direction, a downward direction, and a height direction as viewed from the operator. The front-rear/left-right (width)/up-down (height) directions of the work vehicle 1 respectively coincide with the front-rear/left-right (width)/up-down (height) directions viewed from the operator.

FIG. 1 shows the left side of the work vehicle 1. As shown in FIG. 2, the vehicle body 2 is substantially plane-symmetrical with respect to the vehicle body center plane M, and includes a first side surface 2L that is a left side surface and a second side surface 2R that is a right side surface. Among the pair of travel devices 3, the travel device 3 provided on the first side surface 2L is shown as a first travel device 3L, and the travel device 3 provided on the second side surface 2R is shown as a second travel device 3R. Among the pair of arm mechanisms 42, the arm mechanism 42 provided on the left side with respect to the vehicle body center plane M is shown as a first arm mechanism 42L, and the arm mechanism 42 provided on the right side with respect to the vehicle body center plane M is shown as a second arm mechanism 42R. The link 44 provided on the left side with respect to the vehicle body center plane M is shown as a first link 44L. The arm 45 provided on the left side with respect to the vehicle body center plane M is shown as a first arm 45L, and the arm 45 provided on the right side with respect to the vehicle body center plane M is shown as a second arm 45R. The fulcrum shaft 46 provided on the left side with respect to the vehicle body center plane M is shown as a first fulcrum shaft 46L, and the fulcrum shaft 46 provided on the right side with respect to the vehicle body center plane M is shown as a second fulcrum shaft 46R. The joint shaft 47 provided on the left side with respect to the vehicle body center plane M is shown as a first joint shaft 47L, and the joint shaft 47 provided on the right side with respect to the vehicle body center plane M is shown as a second joint shaft 47R. Among the hydraulic motor devices 30, the hydraulic motor device 30 provided on the left side with respect to the vehicle body center plane M is shown as a first hydraulic motor device 30L, and the hydraulic motor device 30 provided on the right side with respect to the vehicle body center plane M is shown as a second hydraulic motor device 30R.

Referring to FIGS. 1 and 2, the work vehicle 1 further includes an engine 6 provided in a rear portion of the vehicle body 2, and a plurality of hydraulic pumps 7 including a first hydraulic pump 7L and a second hydraulic pump 7R. The engine 6 drives the plurality of hydraulic pumps 7. The first hydraulic pump 7L and the second hydraulic pump 7R are configured to discharge hydraulic fluid to drive the hydraulic motor devices 30 etc. to drive the drive wheels 31. The plurality of hydraulic pumps 7 other than the first hydraulic pump 7L and the second hydraulic pump 7R are configured to discharge hydraulic fluid to drive hydraulic actuators connected to the work device 4 (the plurality of arm cylinders 48, the at least one tool cylinder 49, and the like). The engine 6 is provided between the pair of aim mechanisms 42 in the width direction $D_W$ of the work vehicle 1. Work vehicle 1 further includes a cover 8 for covering engine 6. The work vehicle 1 further includes a bonnet cover 9 provided at the rear end of the vehicle body 2. The bonnet cover 9 is openable and closable to enable a maintenance person to perform maintenance work of the engine 6 and the like.

Figure 3:
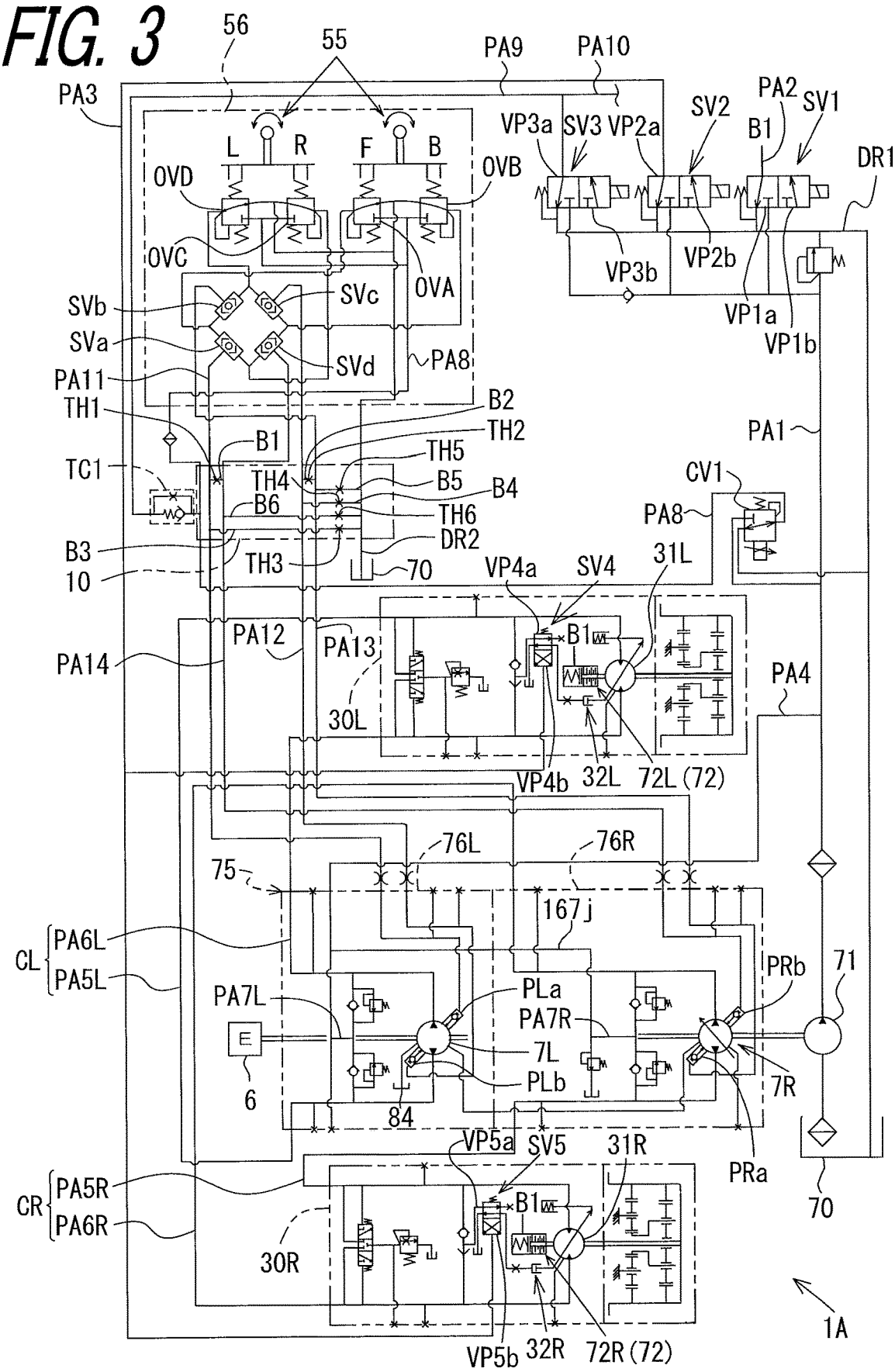
FIG. 3 is a hydraulic circuit diagram of a travel system of a work vehicle.

FIG. 3 is a hydraulic circuit diagram of a travel system of a work vehicle 1. The work vehicle 1 includes a hydraulic circuit 1A. The hydraulic circuit 1A includes a hydraulic fluid tank 70 and a third hydraulic pump 71. The third hydraulic pump 71 is a constant displacement gear pump to be driven by the power of the engine 6. The third hydraulic pump 71 is configured to discharge the hydraulic oil stored in the hydraulic fluid tank 70. In particular, the third hydraulic pump 71 is configured to discharge hydraulic oil mainly used for control. For convenience of description, among the hydraulic oil discharged from the third hydraulic pump 71, the hydraulic oil used for control is referred to as a pilot oil, and the pressure of the pilot oil is referred to as a pilot pressure.

The hydraulic circuit 1A includes a pilot oil supply passage PA1 connected to a discharge port of the first hydraulic pump P1. The pilot oil flows through the pilot oil supply passage PA1. The hydraulic circuit 1A includes a plurality of switching valves (a brake switching valve SV1, a direction switching valve SV2, and a hydraulic lock switching valve SV3) connected to the pilot oil supply passage PA1, and a plurality of brake mechanisms 72. The brake switching valve SV1 is connected to the pilot oil supply passage PA1. The brake switching valve SV1 is a direction switching valve (electromagnetic valve) to brake and release braking by the plurality of brake mechanisms 72. The brake switching valve SV1 is a two position switching valve configured to switch a valve body thereof to a first position VP1*a* or a second position VP1*b* by excitation. Switching of the valve body of the brake switching valve SV1 is performed by an operation member (not illustrated) or the like.

The plurality of brake mechanisms 72 include a first brake mechanism 72L to brake the first travel device 3L and a second brake mechanism 72R to brake the second travel device 3R. The first brake mechanism 72L and the second brake mechanism 72R are connected to the brake switching valve SV1 via an oil passage PA2. The first brake mechanism 72L and the second brake mechanism 72R are configured to brake the travel devices 3 in accordance with the pressure of the pilot oil (hydraulic fluid). When the valve body of the brake switching valve SV1 is switched to the first position VP1*a*, the hydraulic oil is drained from the oil passage PA2 in the section between the brake switching valve SV1 and the brake mechanisms 72, and the travel devices 3 are braked by the brake mechanisms 72. When the valve body of the brake switching valve SV1 is switched to the second position VP1*b*, braking by the brake mechanisms 72 is released. Alternatively, when the valve body of the brake switching valve SV1 is switched to the first position VP1*a*, the braking by the brake mechanisms 72 may be released, and when the valve body of the brake switching valve SV1 is switched to the second position VP1*b*, the travel devices 3 may be braked by the brake mechanisms 72.

The direction switching valve SV2 is an electromagnetic valve to change the rotation of the first hydraulic motor device 30L and the second hydraulic motor device 30R. The direction switching valve SV2 is a two position switching valve configured to switch a valve body thereof to a first position VP2*a* or a second position VP2*b* by excitation. The directional control valve SV2 is switched by an operating member (not illustrated) or the like. The direction switching valve SV2 may be a proportional valve capable of adjusting the flow rate of the hydraulic fluid to be discharged, instead of the two position switching valve.

The first hydraulic motor device 30L is a device to transmit power to the drive wheel 31 provided in the first travel device 3L. The first hydraulic motor device 30L includes a first hydraulic motor 31L, a first swash plate switching cylinder 32L, and a first travel control valve (hydraulic switching valve) SV4. The first hydraulic motor 31L is a swash plate type variable displacement axial motor to drive the first travel device 3L, and is a motor capable of changing the vehicle speed (rotation) to first speed or second speed. The first swash plate switching cylinder 32L is a cylinder configured to change the angle of the swash plate of the first hydraulic motor 31L by expansion and contraction. The first travel control valve SV4 is a valve to expand and contract the first swash plate switching cylinder 32L. The first travel control valve SV4 is a two position switching valve configured to switch a valve body thereof to a first position VP4*a* or a second position VP4*b*.

The first travel control valve SV4 is switched by a directional control valve SV2 located on the upstream side connected to the first travel control valve SV4. Specifically, the direction switching valve SV2 and the first travel control valve SV4 are connected by an oil passage PA3, and the first travel control valve SV4 is switched by the hydraulic oil flowing through the oil passage PA3. For example, when the valve body of the direction switching valve SV2 is switched to the first position VP2*a* by the operation of the operation member, the pilot oil is released in the section between the direction switching valve SV2 and the first travel control valve SV4, and the valve body of the first travel control valve SV4 is switched to the first position VP4*a*. As a result, the first swash plate switching cylinder 32L contracts, and the speed of the first hydraulic motor 31L is changed to the first speed. When the valve body of the direction switching valve SV2 is switched to the second position VP2*b* by the operation of the operation member, the pilot oil is supplied to the first travel control valve SV4 through the direction switching valve SV2, and the valve body of the first travel control valve SV4 is switched to the second position VP4*b*. As a result, the first swash plate switching cylinder 32L extends, and the speed of the first hydraulic motor 31L is changed to the second speed.

The second hydraulic motor device 30R is a device to transmit power to the drive wheel 31 provided in the second travel device 3R. The second hydraulic motor device 30R includes a second hydraulic motor 31R, a second swash plate switching cylinder 32R, and a second travel control valve (hydraulic switching valve) SV5. The second hydraulic motor device 30R is a hydraulic motor to drive the second travel device 3R, and operates in the same manner as the first hydraulic motor device 30L. That is, the second hydraulic motor 31R operates in the same manner as the first hydraulic motor 31L. The second swash plate switching cylinder 32R operates in the same manner as the first swash plate switching cylinder 32L. The second travel control valve SV5 is a two position switching valve configured to switch a valve body thereof to a first position VP5*a* or a second position VP5*b*, and operates in the same manner as the first travel control valve SV4.

A drain oil passage DR1 is connected to the hydraulic circuit 1A. The drain oil passage DR1 is an oil passage through which the pilot oil flows from the plurality of switching valves (the brake switching valve SV1, the direction switching valve SV2, and the hydraulic lock switching valve SV3) to the hydraulic fluid tank 70. For example, the drain oil passage DR1 is connected to discharge ports of a plurality of switching valves (the brake switching valve SV1, the direction switching valve SV2, and the hydraulic lock switching valve SV3). That is, when the brake switching valve SV1 is in the first position VP1*a*, the hydraulic oil is discharged from the oil passage PA2 to the drain oil passage DR1 in the section between the brake switching valve SV1 and the brake mechanisms 72. When the direction switching valve SV2 is at the first position VP1*a*, the pilot oil in the oil passage PA3 is discharged to the drain oil passage DR1.

The hydraulic circuit 1A further includes a first charge oil passage PA4 and a hydraulic drive device 75. The first charge oil passage PA4 is branched from the pilot oil supply passage PA1 and connected to the hydraulic drive device 75. The hydraulic drive device 75 is a device to drive the first hydraulic motor device 30L and the second hydraulic motor device 30R. The hydraulic drive device 75 includes a first drive circuit 76L for driving the first hydraulic motor device 30L and a second drive circuit 76R for driving the second hydraulic motor device 30R.

The first drive circuit 76L includes a first hydraulic pump 7L, drive oil passages PA5L and PA6L, and a second charge oil passage PA7L. The driving oil passages PA5L and PA6L connect the first hydraulic pump 7L and the first hydraulic motor 31L. A hydraulic circuit formed by the driving oil passages PA5L and PA6L is referred to as a first hydraulic circuit CL. The second charge oil passage PA7L is an oil passage that is connected to the driving oil passages PA5L and PA6L and replenishes the driving oil passages PA5L and PA6L with the hydraulic oil from the third hydraulic pump 71.

Similarly, the second drive circuit 76R includes a second hydraulic pump 7R, drive oil passages PA5R and PA6R, and a third charge oil passage PA7R. The driving oil passages PA5R and PA6R connect the second hydraulic pump 7R and the second hydraulic motor 31R. A hydraulic circuit formed by the drive oil passages PA5R and PA6R is referred to as a second hydraulic circuit CR. The third charge oil passage PA7R is an oil passage that is connected to the driving oil passages PA5R and PA6R and replenishes the driving oil passages PA5R and PA6R with the hydraulic oil from the third hydraulic pump 71.

The first hydraulic pump 7L and the second hydraulic pump 7R are swash plate type variable displacement axial pumps to be driven by the power of the engine 6. The first hydraulic pump 7L is connected to the first hydraulic motor 31L via the first hydraulic circuit CL, and has a first port PLa and a second port PLb on which the pilot pressure acts. In the first hydraulic pump 7L, the angle of the swash plate is changed by the pilot pressure acting on the first port PLa and the second port PLb. Specifically, the first hydraulic pump 7L is configured to supply hydraulic fluid to the first hydraulic motor 31L via the first hydraulic circuit CL to drive the first travel device 3L forward when the hydraulic pressure applied to the first port PLa is higher than the hydraulic pressure applied to the second port PLb, and to supply hydraulic fluid to the first hydraulic motor 31L via the first hydraulic circuit CL to drive the first travel device 3L backward when the hydraulic pressure applied to the second port PLb is higher than the hydraulic pressure applied to the first port PLa.

The second hydraulic pump 7R is connected to the second hydraulic motor 31R via the second hydraulic circuit CR, and has a third port PRa and a fourth port PRb on which the pilot pressure acts. In the second hydraulic pump 7R, the angle of the swash plate is changed by the pilot pressure acting on the third port PRa and the fourth port PRb. Specifically, the second hydraulic pump 7R is configured to supply hydraulic fluid to the second hydraulic motor 31R via the second hydraulic circuit CR to drive the second travel device 3R forward when the hydraulic pressure applied to the third port PRa is higher than the hydraulic pressure applied to the fourth port PRb, and to supply hydraulic fluid to the second hydraulic motor 31R via the second hydraulic circuit CR to drive the second travel device 3R backward when the hydraulic pressure applied to the fourth port PRb is higher than the hydraulic pressure applied to the third port PRa. The first hydraulic pump 7L and the second hydraulic pump 7R can change the output (the discharge amount of the hydraulic oil) and the discharge direction of the hydraulic oil according to the angle of the swash plate.

The outputs of the first hydraulic pump 7L and the second hydraulic pump 7R and the discharge direction of the hydraulic oil are changed by the operation device 56. Specifically, the outputs of the first hydraulic pump 7L and the second hydraulic pump 7R and the discharge direction of the hydraulic oil are changed according to the operation of the operation lever 55 included in the operation device 56. That is, the operation device 56 is a device to select at least one travel device out of the first travel device 3L and the second travel device 3R and to operate forward or backward movement of the at least one travel device.

As shown in FIG. 3, the hydraulic circuit 1A includes an oil passage PA8 branched from the pilot oil supply passage PA1 and connected to the operation device 56, and a pilot pressure control valve CV1 provided on the oil passage PA8. The pilot pressure control valve CV1 is an electromagnetic proportional valve to control the pilot pressure supplied to the operation device 56. The hydraulic circuit 1A further includes a throttle check valve TC1 connected to the oil passage PA8, and an oil passage PA9 connecting the throttle check valve TC1 and the hydraulic lock switching valve SV3. The throttle check valve TC1 is configured to allow a large amount of pilot oil to flow from the oil passage PA8 to the oil passage PA9 when the oil pressure of the oil passage PA8 is higher than the oil pressure of the oil passage PA9 and the oil pressure difference is higher than a predetermined threshold value, and to limit the amount of oil flowing between the oil passage PA8 and the oil passage PA9 otherwise.

The hydraulic lock switching valve SV3 is a two position switching valve configured to switch a valve body thereof to a first position VP3*a* or a second position VP3*b*. The switching of the valve body of the hydraulic lock switching valve SV3 is performed by an operation member (not shown) or the like. When the valve body of the hydraulic lock switching valve SV3 is switched to the first position VP3*a*, the hydraulic oil (pilot oil) in the oil passage PA9 is discharged to the hydraulic fluid tank 70. The oil passage PA9 is also connected to an oil passage PA10 that is connected to an operation device for controlling the work device 4 (not shown), and the pilot oil in the oil passage PA9 is discharged to the hydraulic fluid tank 70, whereby the pilot oil is not supplied to the operation device for controlling the work device 4. Further, even when it is not necessary to supply the operating oil (pilot oil) to the operation device 56, for example, when the work vehicle 1 is stopped, the warm-up can be performed by flowing the operating oil through the oil passage PA8, the throttle check valve TC1, the oil passage PA9, and the drain oil passage DR1. Therefore, the oil passage PA8 and the oil passage PA9 are also referred to as warm-up oil passages. When the valve body of the hydraulic lock switching valve SV3 is switched to the second position VP3*b*, the pilot oil in the pilot oil supply passage PA1 is supplied to the oil passage PA10. Thus, the pilot oil is supplied to the operation device for controlling the work device 4.

The operation device 56 includes an operating valve OVA for forward travel, an operating valve OVB for rearward travel, an operating valve OVC for right turn, an operating valve OVD for left turn, and an operation lever 55. The operation device 56 includes first to fourth shuttle valves SVa, SVb, SVc, and SVd. The operating valves OVA, OVB, OVC, and OVD are operated by a single operation lever 55. The operating valves OVA, OVB, OVC, and OVD change the pressure of the hydraulic fluid according to the operation of the operation lever 55, and supply the changed hydraulic fluid to the first port PLa and the second port PLb of the first hydraulic pump 7L and the third port PRa and the fourth port PRb of the second hydraulic pump 7R. In this embodiment, the operating valves OVA, OVB, OVC, and OVD are operated by the single operation lever 55, but a plurality of operation levers 55 may be provided.

The operating valves OVA, OVB, OVC, and OVD have discharge ports (ports). As shown in FIG. 3, the discharge port is connected to a drain oil passage DR2 leading to the hydraulic fluid tank 70. The operation lever 55 is tiltable from the neutral position in the front-rear direction, the width direction orthogonal to the front-rear direction, and the oblique direction.

The operating valves OVA, OVB, OVC, and OVD of the operation device 56 are operated in accordance with the tilting of the operation lever 55. Thus, the pilot pressure proportional to the operation amount of the operation lever 55 from the neutral position is output from the second side ports of the operating valves OVA, OVB, OVC, and OVD.

When the operation lever 55 is tilted forward, the operating valve OVA for forward travel is operated, and the pilot pressure is output from the operating valve OVA. The pilot pressure acts on the first port PLa from the first shuttle valve SVa via a first pilot oil passage PA11 connecting the operation device 56 and the first port PLa of the first hydraulic pump 7L, and acts on the third port PRa from the second shuttle valve SVb via a third pilot oil passage PA13 connecting the operation device 56 and the third port PRa of the second hydraulic pump 7R. As a result, the output shaft of the first hydraulic pump 7L and the output shaft of the second hydraulic pump 7R rotate forward (forward rotation)

at a speed proportional to the amount of tilt of the operation lever 55, and the work vehicle 1 moves straight forward.

When the operation lever 55 is tilted rearward, the operating valve OVB for rearward travel is operated to output a pilot pressure. The pilot pressure acts on the second port PLb of the first hydraulic pump 7L from the third shuttle valve SVc via a second pilot oil passage PA12 connecting the operation device 56 and the second port, and acts on the fourth port PRb from the fourth shuttle valve SVd via a fourth pilot oil passage PA14 connecting the operation device 56 and the fourth port PRb of the second hydraulic pump 7R. As a result, the output shaft of the first hydraulic pump 7L and the output shaft of the second hydraulic pump 7R rotate in reverse (reverse rotation) at a speed proportional to the amount of tilting of the operation lever 55, and the work vehicle 1 moves straight rearward.

When the operation lever 55 is tilted to the right, the operating valve OVC for turning to the right is operated, and the pilot pressure is output from the operating valve OVC. This pilot pressure acts on the first port PLa of the first hydraulic pump 7L from the first shuttle valve SVa via the first pilot oil passage PA11, and also acts on the fourth port PRb of the second hydraulic pump 7R from the fourth shuttle valve SVd via the fourth pilot oil passage PA14. As a result, the output shaft of the first hydraulic pump 7L rotates in the forward direction and the output shaft of the second hydraulic pump 7R rotates in the reverse direction, so that the work vehicle 1 turns to the right.

Further, when the operation lever 55 is tilted to the left, the operating valve OVD for turning to the left is operated, and the pilot pressure is output from the operating valve OVD. This pilot pressure acts on the third port PRa of the second hydraulic pump 7R from the second shuttle valve SVb via the third pilot oil passage PA13, and also acts on the second port PLb of the first hydraulic pump 7L from the third shuttle valve SVc via the second pilot oil passage PA12. Thus, the output shaft of the second hydraulic pump 7R rotates in the forward direction and the output shaft of the first hydraulic pump 7L rotates in the reverse direction, so that the work vehicle 1 turns to the left.

That is, when the operation lever 55 is tilted diagonally forward to the left, the work vehicle 1 turns to the left while moving forward at a speed corresponding to the tilt angle of the operation lever 55. When the operation lever 55 is tilted obliquely forward to the right, the work vehicle 1 turns to the right while moving forward at a speed corresponding to the tilt angle of the operation lever 55. When the operation lever 55 is tilted diagonally backward to the left, the work vehicle 1 turns left while moving backward at a speed corresponding to the tilt angle of the operation lever 55. When the operation lever 55 is tilted obliquely backward to the right, the work vehicle 1 turns to the right while moving backward at a speed corresponding to the tilt angle of the operation lever 55.

The hydraulic circuit 1A further includes a first bypass oil passage B1, a second bypass oil passage B2, a third bypass oil passage B3, a fourth bypass oil passage B4, a fifth bypass oil passage B5, and a sixth bypass oil passage B6. The first bypass oil passage B1 connects the first pilot oil passage PA11 and the fourth pilot oil passage PA14. The second bypass oil passage B2 connects the second pilot oil passage PA12 and the third pilot oil passage PA13. The third bypass oil passage B3 connects the first pilot oil passage PA11 and the drain oil passage DR2. The fourth bypass oil passage B4 connects the second pilot oil passage PA12 and the drain oil passage DR2. The fifth bypass oil passage B5 connects the third pilot oil passage PA13 and the drain oil passage DR2. The sixth bypass oil passage B6 connects the fourth pilot oil passage PA14 and the drain oil passage DR2.

The hydraulic circuit 1A further includes a first throttle TH1, a second throttle TH2, a third throttle TH3, a fourth throttle TH4, a fifth throttle TH5, and a sixth throttle TH6. The first throttle TH1 is provided in the first bypass oil passage B1. The second throttle TH2 is provided in the second bypass oil passage B2. The third throttle TH3 is provided in the third bypass oil passage B3. The fourth throttle TH4 is provided in the fourth bypass oil passage B4. The fifth throttle TH5 is provided in the fifth bypass oil passage B5. The sixth throttle TH6 is provided in the sixth bypass oil passage B6. The first bypass oil passage B1 to the sixth bypass oil passage B6 and the first throttle TH1 to the sixth throttle TH6 are formed by the connector (relay member) 10 that is integrally molded. That is, the first bypass oil passage B1 to the sixth bypass oil passage B6 and the first throttle TH1 to the sixth throttle TH6 are provided inside the connector 10. The first pilot oil passage PA11, the second pilot oil passage PA12, the third pilot oil passage PA13, and the fourth pilot oil passage PA14 pass through an identical connector 10.

The first bypass oil passage B1 and the first throttle TH1 allow oil to escape from the first pilot oil passage PA11 to the fourth pilot oil passage PA14 when a right pivot turn is to be performed from the forward movement. Therefore, the pilot pressure of the fourth port PRb is increased. In a case where the first bypass oil passage B1 and the first throttle TH1 are not provided, the differential pressure between the pilot pressure of the third port PRa and the pilot pressure of the fourth port PRb increases as the tilting amount of the operation lever 55 for forward movement increases when the vehicle turns from forward movement to the right pivot turn, even if the operation lever 55 is subsequently tilted to the right by the same degree. Therefore, in order to shift to the right pivot turn, it is necessary to tilt the operation lever 55 further to the right. Therefore, the operation of the operation lever 55 for changing from the forward movement to the right pivot turn differs depending on the tilting operation of the operation lever 55 of the immediately preceding forward movement, thereby reducing the operability. On the other hand, when the first bypass oil passage B1 and the first throttle TH1 are provided, the pilot pressure of the fourth port PRb increases as the forward lever operation increases. Therefore, even if the operation lever 55 is thereafter tilted to the right by the same degree, the differential pressure between the pilot pressure of the third port PRa and the pilot pressure of the fourth port PRb is smaller than that in the case where the first bypass oil passage B1 and the first throttle TH1 are not provided. Therefore, when the right pivot turn is to be performed from the forward movement, even if the lever operation of the immediately preceding forward movement is different, the right pivot turn can be performed by a similar tilting operation to the right side. Therefore, the operability of shifting from the forward movement to the right pivot turn is improved.

Further, since the first bypass oil passage B1 and the first throttle TH1 allow the oil to escape from the fourth pilot oil passage PA14 to the first pilot oil passage PA11 when the forward movement is to be performed from the right pivot turn while moving forward, the differential pressure between the pilot pressure of the third port PRa and the pilot pressure of the fourth port PRb becomes larger than that in the case where the first bypass oil passage B1 and the first throttle TH1 are not provided. Therefore, when the forward movement is to be performed from the right pivot turn while moving forward, even if the lever operation of the immediately preceding right pivot turn is different, the forward movement can be performed by a similar forward tilting operation. Therefore, the operability of shifting from the right pivot turn while moving forward to the forward movement is improved.

Further, since the second bypass oil passage B2 and the second throttle TH2 allow the oil to escape from the second pilot oil passage PA12 to the third pilot oil passage PA13 when the right pivot turn is to be performed the from the backward movement, the differential pressure between the pilot pressure of the third port PRa and the pilot pressure of the fourth port PRb becomes smaller than that in the case where the second bypass oil passage B2 and the second throttle TH2 are not provided. Therefore, when the right pivot turn is to be performed from the backward movement, the right pivot turn can be performed by a similar rightward tilting operation even if the lever operation of the immediately preceding backward movement is different. Therefore, the operability of shifting from the backward movement to the right pivot turn is improved.

In addition, even in a case where the backward movement is to be performed from the right pivot turn while moving backward, the second bypass oil passage B2 and the second throttle TH2 allow the oil to escape from the third pilot oil passage PA13 to the second pilot oil passage PA12. Thus, the differential pressure between the pilot pressure of the third port PRa and the pilot pressure of the fourth port PRb is larger than that in the case where the second bypass oil passage B2 and the second throttle TH2 are not provided. Therefore, when the backward movement is to be performed from the right pivot turn while moving backward, even if the lever operation of the immediately preceding right pivot turn is different, the backward movement can be performed by a similar rearward tilting operation. Therefore, the operability of shifting from the right pivot turn while moving backward to the backward movement is improved.

Similarly, the second bypass oil passage B2 and the second throttle TH2 allow the oil to escape from the third pilot oil passage PA13 to the second pilot oil passage PA12 when a left pivot turn is performed from forward movement. Therefore, the pilot pressure of the second port PLb is increased. In a case where the second bypass oil passage B2 and the second throttle TH2 are not provided, the differential pressure between the pilot pressure of the first port PLa and the pilot pressure of the second port PLb increases as the tilting of the operation lever 55 for the forward movement increases when the left pivot turn is performed from the forward movement even if the operation lever 55 is tilted to the left by the same degree. Therefore, in order to shift to the left pivot turn, it is necessary to tilt the operation lever 55 further to the left. Therefore, the operation of the operation lever 55 for changing from the forward movement to the left pivot turn differs depending on the tilting operation of the operation lever 55 of the immediately preceding forward movement, thereby reducing the operability. On the other hand, when the second bypass oil passage B2 and the second throttle TH2 are provided, the pilot pressure of the second port PLb increases as the forward lever operation increases. Therefore, even if the operation lever 55 is thereafter tilted to the left by the same degree, the differential pressure between the pilot pressure of the first port PLa and the pilot pressure of the second port PLb becomes smaller than that in the case where the second bypass oil passage B2 and the second throttle TH2 are not provided. Therefore, when the left pivot turn is to be performed from the forward movement, even if the lever operation of the immediately preceding forward movement is different, the left pivot turn can be performed by a similar tilting operation to the left. Therefore, the operability of shifting from the forward movement to the left pivot turn is improved.

Further, since the second bypass oil passage B2 and the second throttle TH2 allow the oil to escape from the second pilot oil passage PA12 to the third pilot oil passage PA13 when the forward movement is to be performed from the left pivot turn while moving forward, the differential pressure between the pilot pressure of the first port PLa and the pilot pressure of the second port PLb becomes larger than that in the case where the second bypass oil passage B2 and the second throttle TH2 are not provided. Therefore, when the forward movement is to be performed from the left pivot turn while moving forward, the forward movement can be performed by a similar forward tilting operation even if the lever operation of the immediately preceding left pivot turn is different. Therefore, the operability of shifting from the left pivot turn while moving forward to the forward movement is improved.

Further, since the first bypass oil passage B1 and the first throttle TH1 allow the oil to escape from the fourth pilot oil passage PA14 to the first pilot oil passage PA11 when the left pivot turn is to be performed from the backward movement, the differential pressure between the pilot pressure of the first port PLa and the pilot pressure of the second port PLb becomes smaller than that in the case where the first bypass oil passage B1 and the first throttle TH1 are not provided. Therefore, when the left pivot turn is to be performed from the backward movement, even if the lever operation of the immediately preceding backward movement is different, the left pivot turn can be performed by a similar tilting operation to the left. Therefore, the operability of shifting from the backward movement to left pivot turn is improved.

In addition, even in a case where the backward movement is to be performed from the left pivot turn while moving backward, the first bypass oil passage B1 and the first throttle TH1 allow the oil to escape from the first pilot oil passage PA11 to the fourth pilot oil passage PA14. Thus, the differential pressure between the pilot pressure of the first port PLa and the pilot pressure of the second port PLb is larger than that in a case where the first bypass oil passage B1 and the first throttle TH1 are not provided. Therefore, when the backward movement is to be performed from the left pivot turn while moving backward, even if the lever operation of the immediately preceding left pivot turn is different, the backward movement can be performed by a similar rearward tilting operation. Therefore, the operability of shifting from the left pivot turn while moving backward to the backward movement is improved.

Since the pilot pressure of the first pilot oil passage PA11 is higher than the hydraulic pressure of the drain oil passage DR2, the air accumulated in the first pilot oil passage PA11 is easily discharged to the drain oil passage DR2 via the third bypass oil passage B3 and the third throttle TH3. Similarly, since the pilot pressure of the second pilot oil passage PA12 is higher than the hydraulic pressure of the drain oil passage DR2, the air accumulated in the second pilot oil passage PA12 is easily discharged to the drain oil passage DR2 via the fourth bypass oil passage B4 and the fourth throttle TH4. Since the pilot pressure of the third pilot oil passage PA13 is higher than the hydraulic pressure of the drain oil passage DR2, the air accumulated in the third pilot oil passage PA13 is easily discharged to the drain oil passage DR2 via the fifth bypass oil passage B5 and the fifth throttle TH5. Since the pilot pressure of the fourth pilot oil passage PA14 is higher than the hydraulic pressure of the drain oil passage DR2, the air accumulated in the fourth pilot oil passage PA14 is easily discharged to the drain oil passage DR2 via the sixth bypass oil passage B6 and the sixth throttle TH6. Since the drain oil passage DR2 includes an air vent hole AV (see FIG. 11), which will be described later, the above-described configuration makes it possible to vent air accumulated in the first pilot oil passage PA11, the second pilot oil passage PA12, the third pilot oil passage PA13, and the fourth pilot oil passage PA14.

Figure 4:
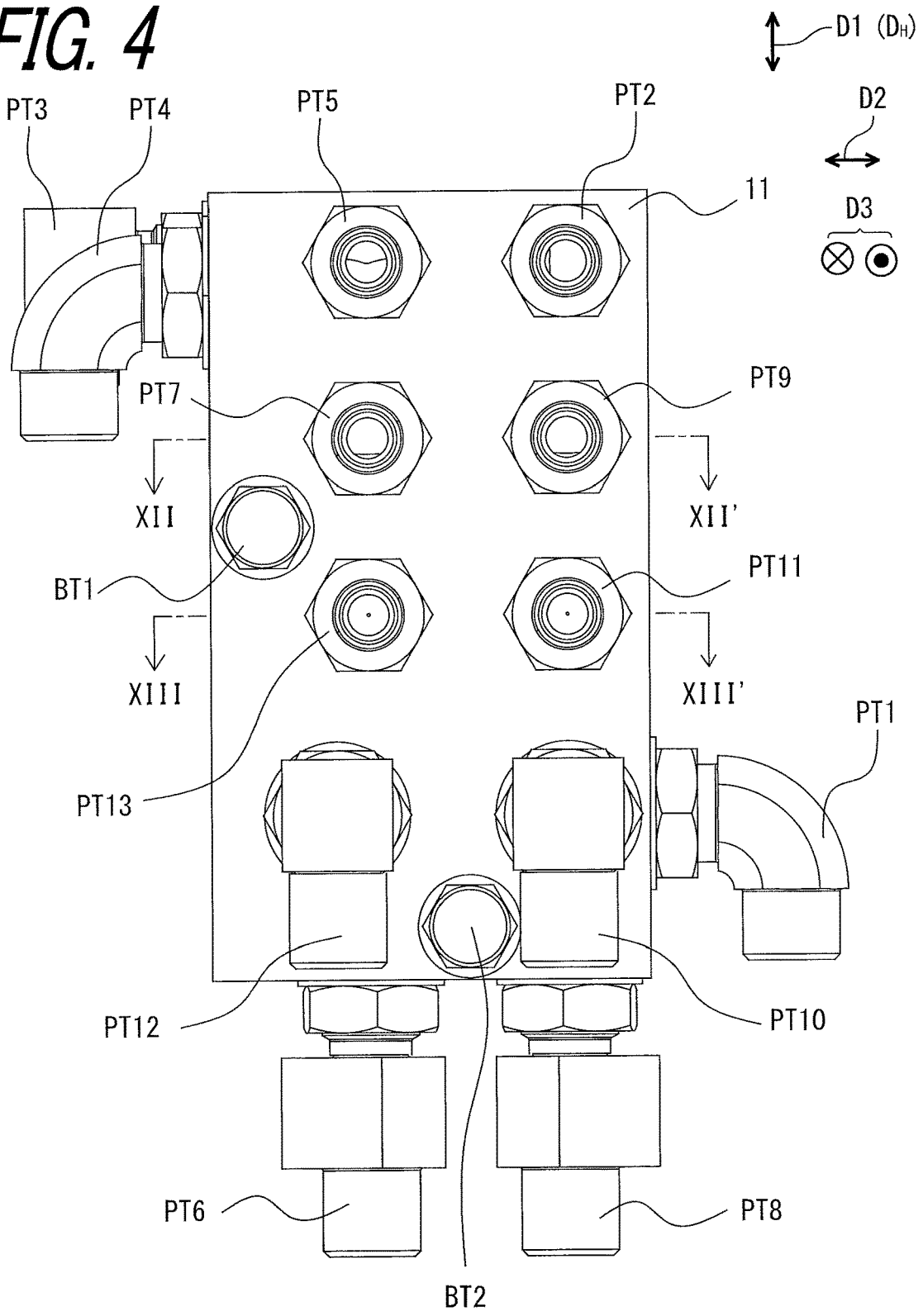
FIG. 4 is a front view of the connector.
Figure 5:
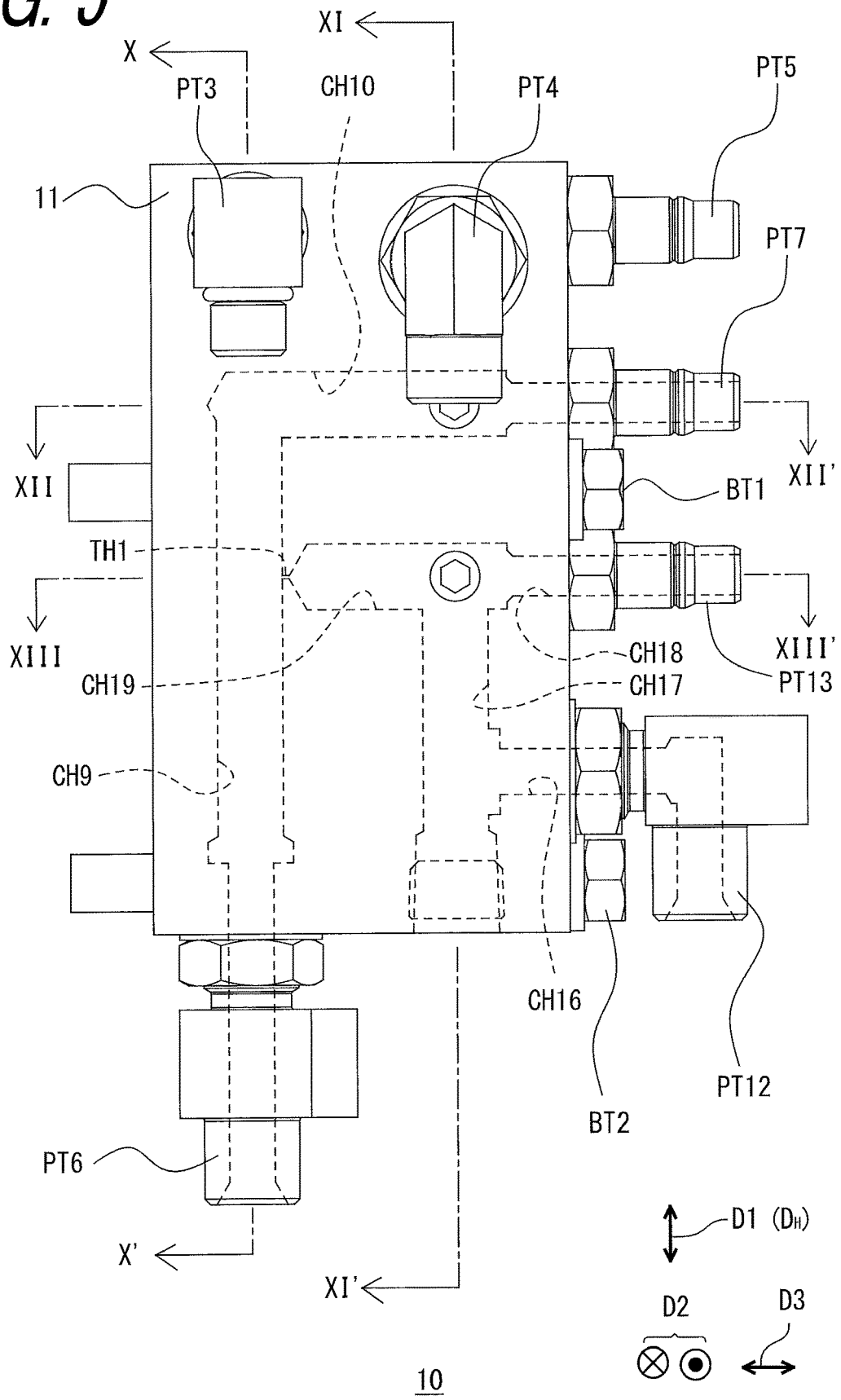
FIG. 5 is a left side view of the connector.
Figure 6:
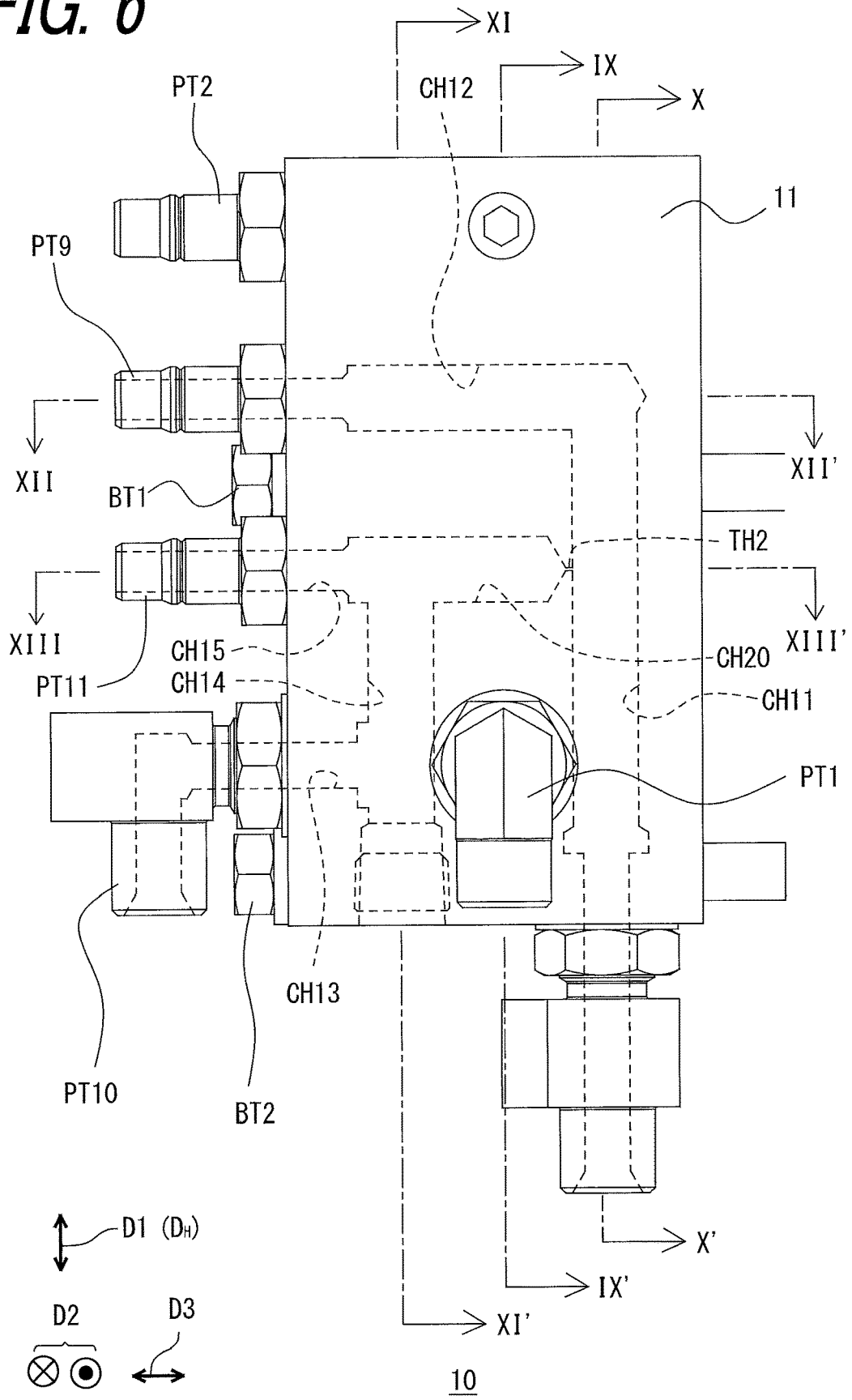
FIG. 6 is a right side view of the connector.
Figure 7:
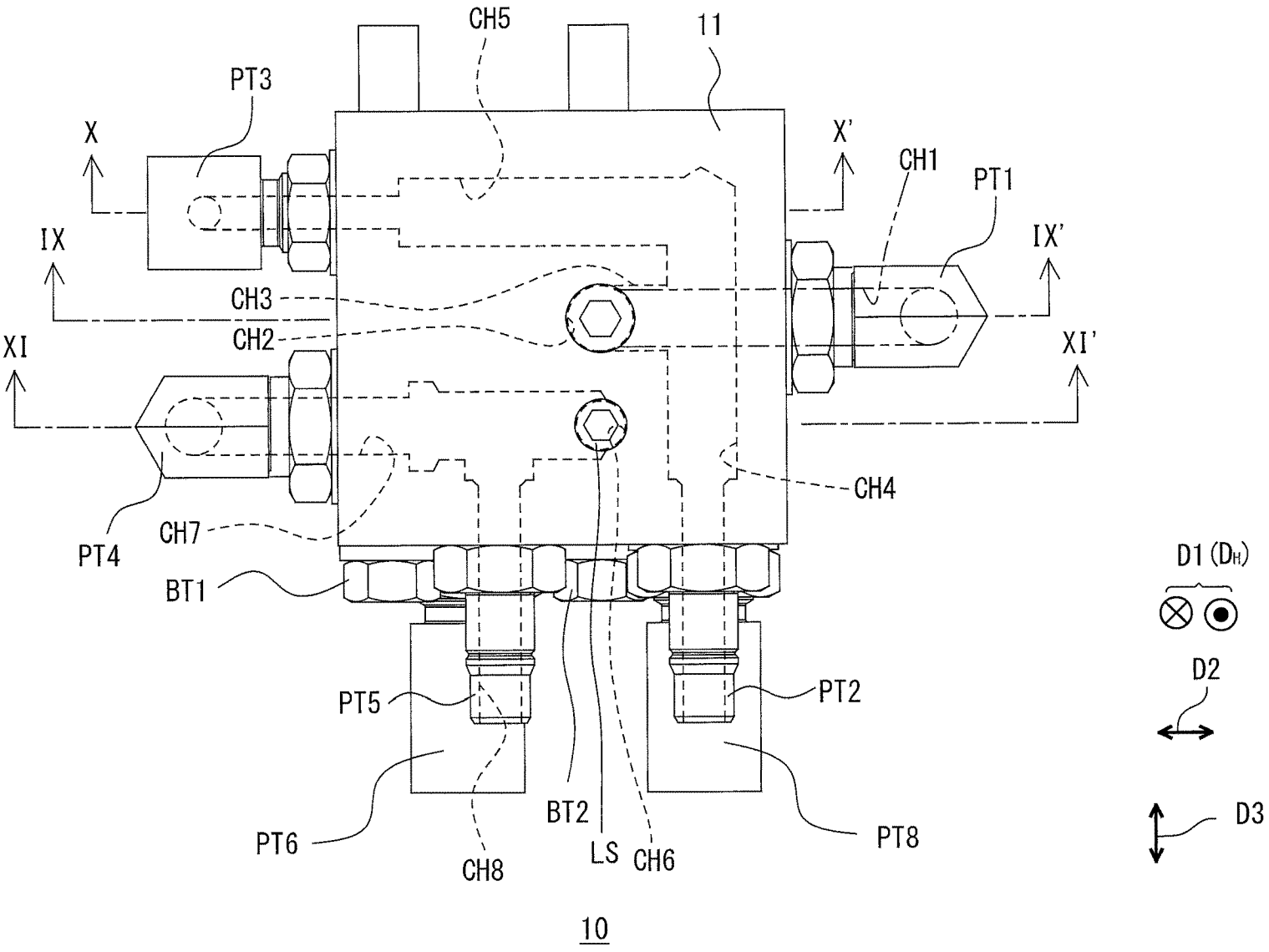
FIG. 7 is a top view of the connector.
Figure 8:
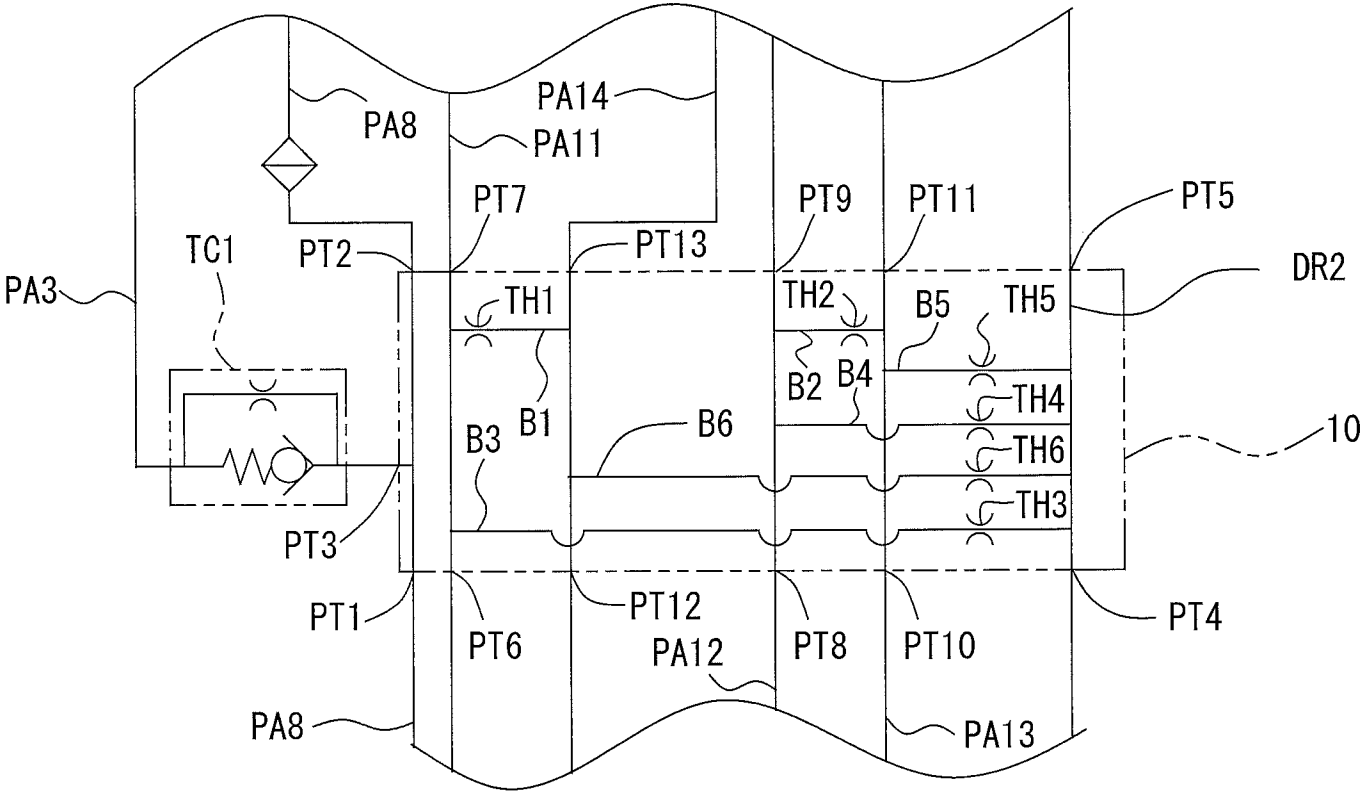
FIG. 8 is an enlarged view of a hydraulic circuit in the vicinity of the connector of FIG. 3.

FIG. 4 is a front view of the connector 10. FIG. 5 is a left side view of the connector 10. FIG. 6 is a right side view of the connector 10. FIG. 7 is a top view of the connector 10. FIG. 8 is an enlarged view of a hydraulic circuit in the vicinity of the connector of FIG. 3. The connector 10 is made of a metal material having excellent thermal conductivity, such as aluminum or iron. The connector 10 includes a connector body 11 having a substantially rectangular parallelepiped shape and a plurality of ports PT1 to PT13. The connector 10 extends in a longitudinal direction D1. The connector 10 is fixed to the vehicle body 2 by fastening members BT1 and BT2 such as bolts so that the longitudinal direction D1 is substantially parallel to a height direction DH along a height of the work vehicle 1. FIG. 8 illustrates locations in the hydraulic circuit corresponding to the plurality of ports PT1 to PT13.

Figure 9:
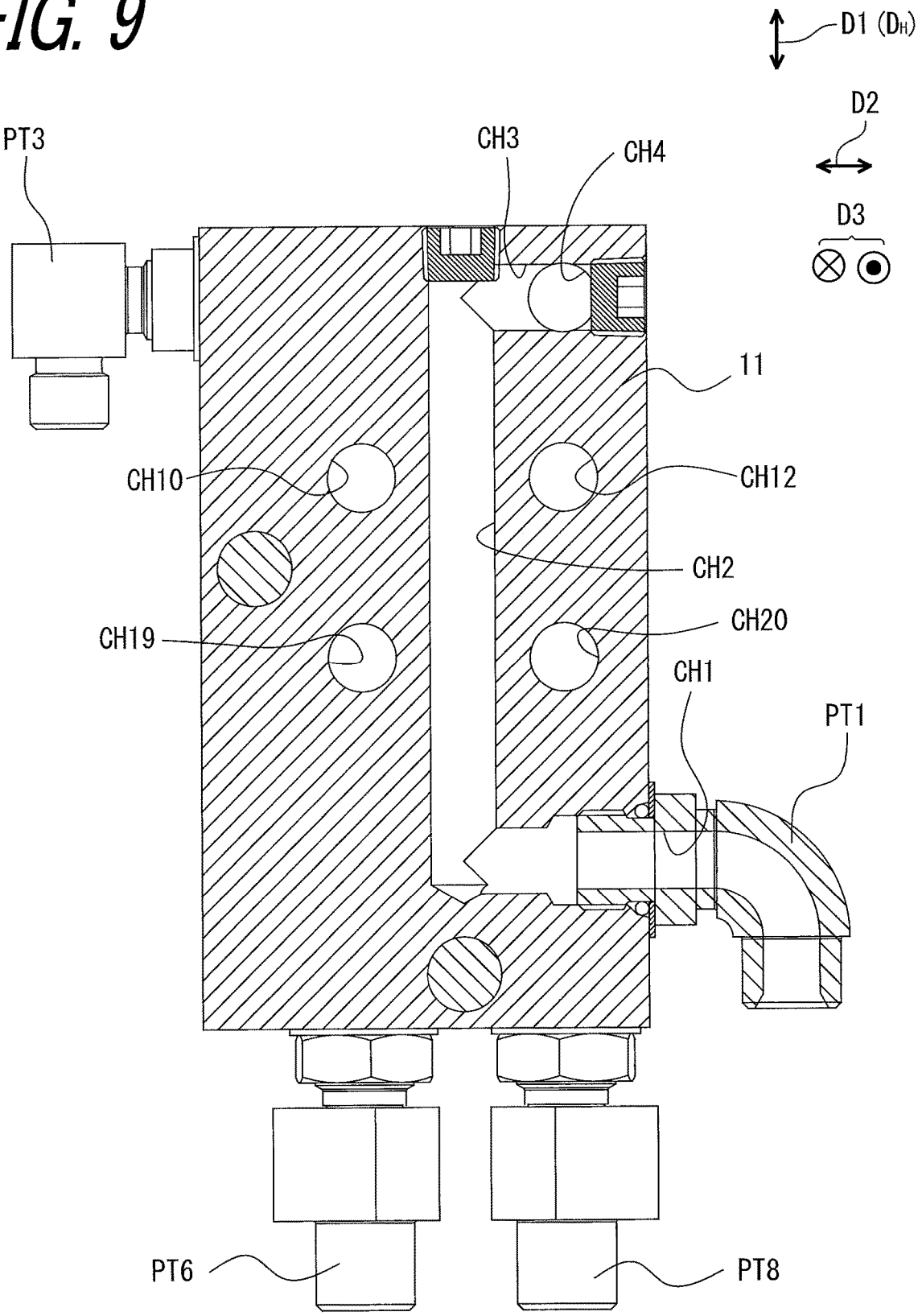
FIG. 9 is a cross-sectional view taken along line IX-IX' of FIGS. 6 and 7.
Figure 10:
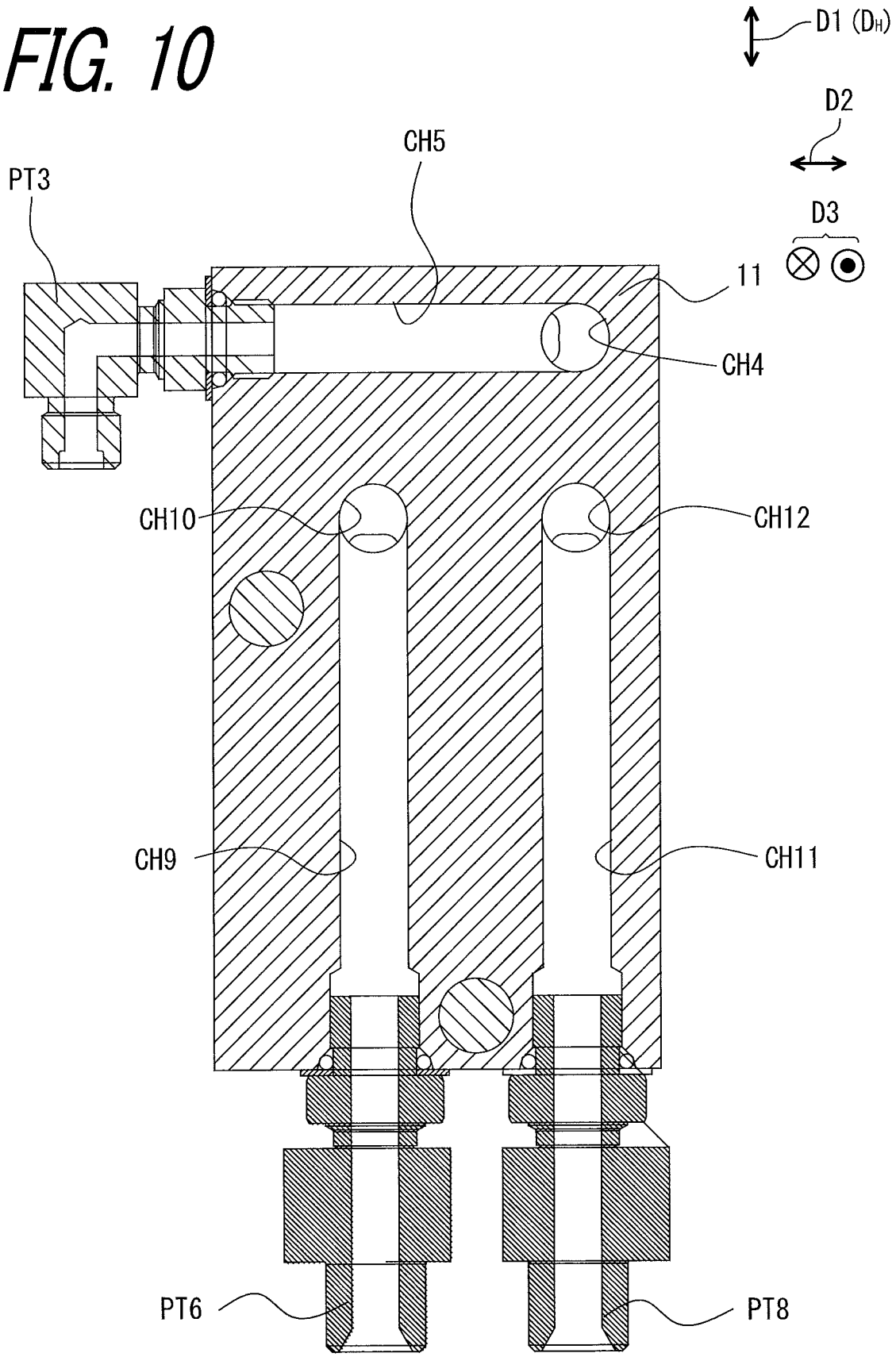
FIG. 10 is a cross-sectional view taken along line X-X' of FIGS. 5 to 7.

FIG. 9 is a cross-sectional view taken along line IX-IX' of FIGS. 6 and 7. FIG. 10 is a cross-sectional view taken along line X-X' of FIGS. 5 to 7. Referring to FIGS. 7, 9, and 10, the connector 10 includes channels CH1, CH2, CH3, CH4, and CH5 forming a warm-up oil passage PA8. In FIG. 7, the channels CH1, CH2, CH3, CH4, and CH5 are indicated by dotted lines or two-dot chain lines. The channel CH2 extends in the longitudinal direction D1 at substantially the center of the connector 10 when viewed in the longitudinal direction D1 of the connector 10. The channel CH2 may be referred to as a fifth segment. The channel CH1 extends in a first cross direction D2 perpendicular to the longitudinal direction D1 and connects the port PT1 and one end of the channel CH2. The channel CH4 is connected to the port PT2 at one end thereof and extends in a second cross direction D3 perpendicular to the longitudinal direction D1 and the first cross direction D2. The channel CH3 connects the channel CH4 to the other end of the channel CH2 opposite to the one end of the channel CH2, and extends in the first cross direction D2. The channel CH5 connects the port PT2 to the other end of the channel CH4 opposite to the one end to the channel CH4, and extends in the first cross direction D2.

Figure 11:
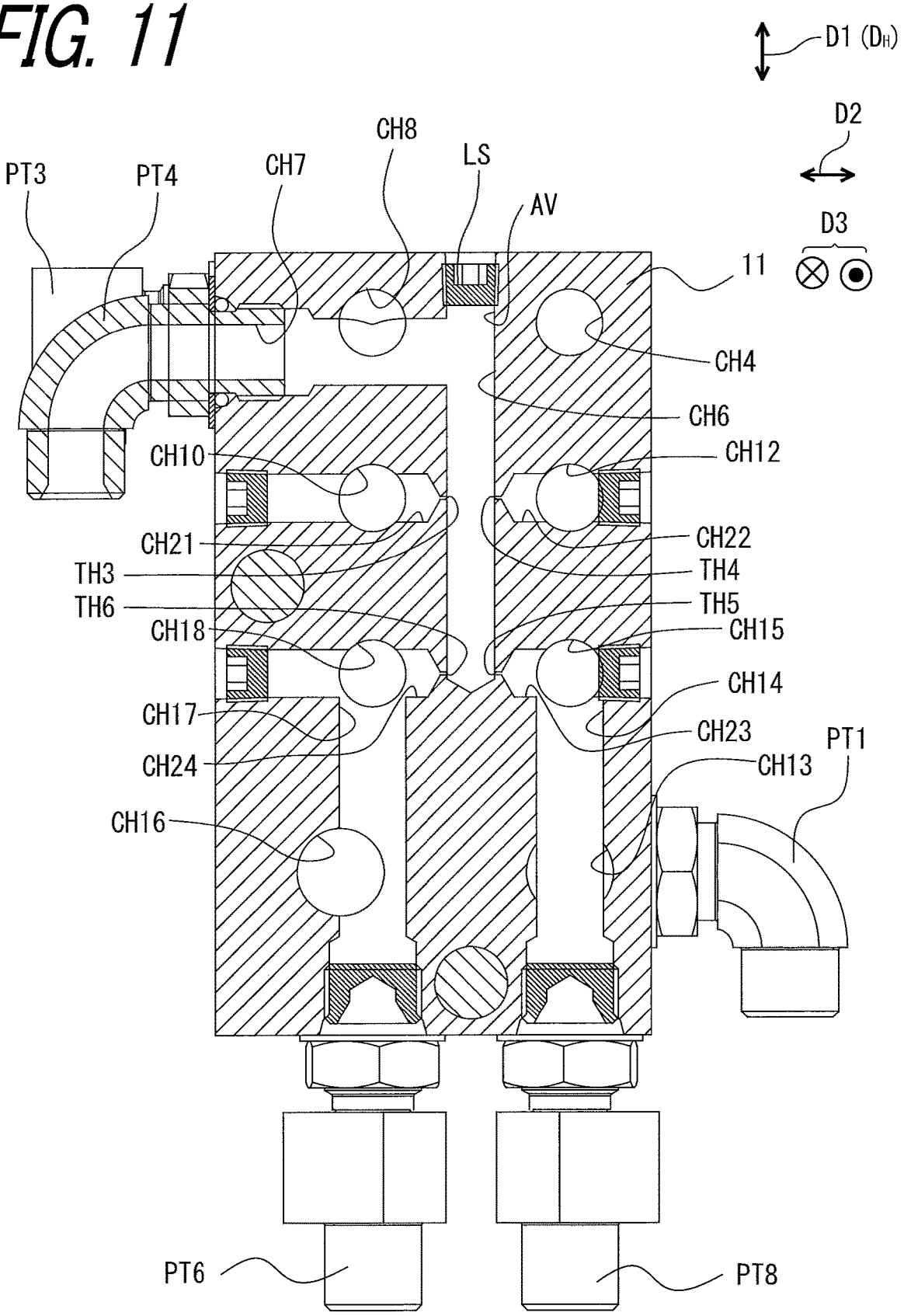
FIG. 11 is a cross-sectional view taken along line XI-XI' of FIGS. 5 to 7.

FIG. 11 is a cross-sectional view taken along line XI-XI' of FIGS. 5 to 7. Referring to FIGS. 7 and 11, the connector 10 includes channels CH6, CH7, and CH8 forming a drain oil passage DR2. In FIG. 7, the channels CH6, CH7, and CH8 are indicated by dotted lines. The channel CH6 is a channel connected to the third throttle TH3 to the sixth throttle TH6 and extends in the longitudinal direction D1 inside the connector 10. The channel CH6 may be referred to as a sixth segment. As shown in FIG. 11, the connector 10 includes an air vent hole AV connected to the upper end of the channel CH6 (sixth segment). Air accumulated in the first pilot oil passage PA11, the second pilot oil passage PA12, the third pilot oil passage PA13, and the fourth pilot oil passage PA14 can be discharged by removing the set screw LS of the air vent hole AV. The channel CH7 connects the port PT4 and the upper end of the channel CH6 and extends in the first cross direction D2. The channel CH8 connects the port PT5 and the channel CH7 and extends in the second cross direction D3.

Figure 12:
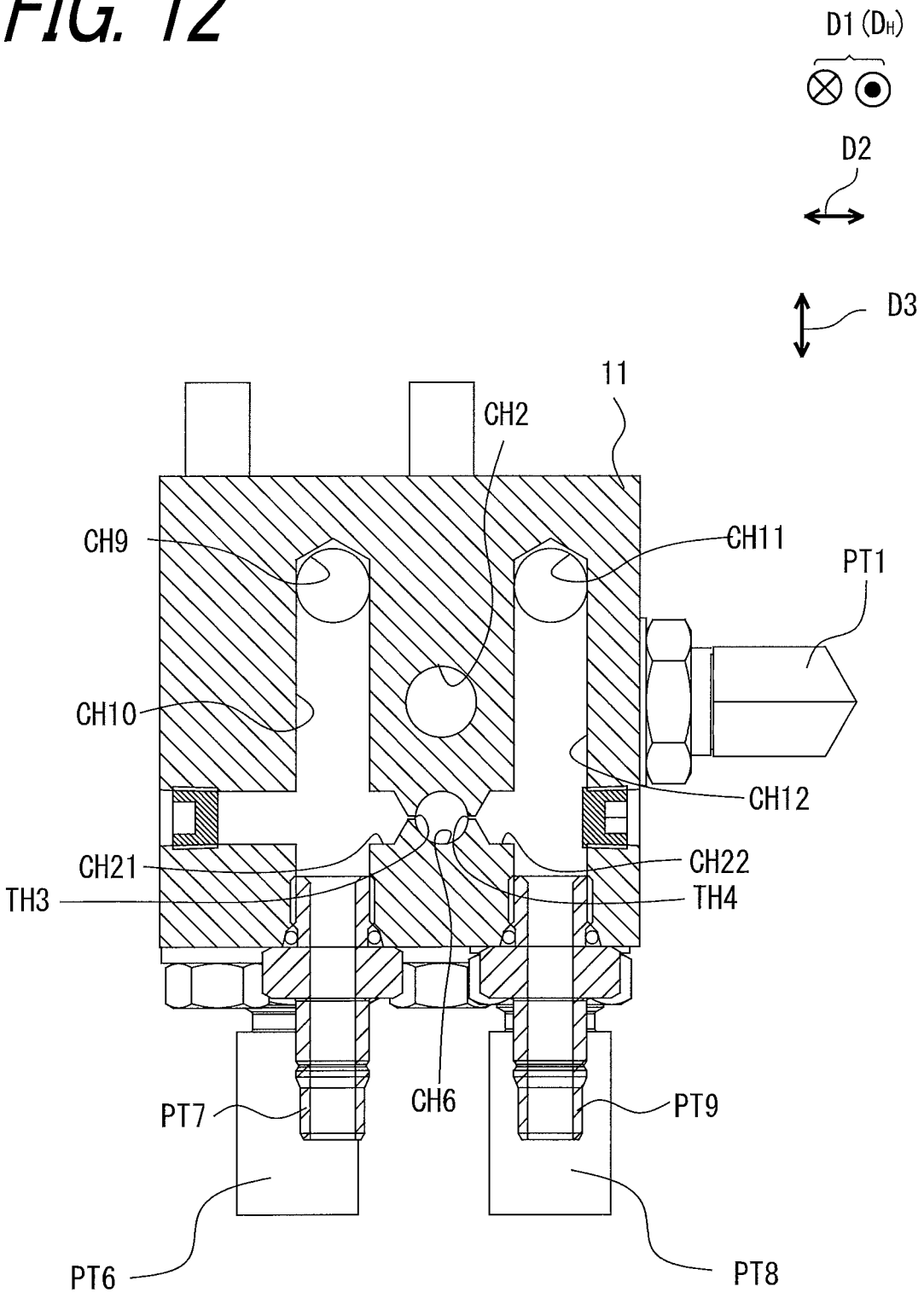
FIG. 12 is a cross-sectional view taken along line XII-XII' of FIGS. 4 to 6.

FIG. 12 is a cross-sectional view taken along line XII-XII' of FIGS. 4 to 6. Referring to FIGS. 5 10, and 12, the connector 10 includes channels CH9 and CH10 that form a fourth pilot oil passage PA14. In FIG. 5, the channels CH9 and CH10 are indicated by dotted lines. The channel CH9 connects the port PT6 and the channel CH10, and extends in the longitudinal direction D1 inside the connector 10. The channel CH10 connects the port PT7 and the upper end of the channel CH9, and extends in the second cross direction D3 inside the connector 10. Thus, the fourth pilot oil passage PA14 is bent inside the connector 10. The channel CH9 may be referred to as a fourth segment. The channel CH10 may be referred to as a tenth segment. Referring to FIGS. 6, 10, and 12, the connector 10 includes channels CH11 and CH12 that form a third pilot oil passage PA13. In FIG. 6, the channels CH11 and CH12 are indicated by dotted lines. The channel CH11 connects the port PT8 and the channel CH12, and extends in the longitudinal direction D1 inside the connector 10. The channel CH12 connects the port PT9 and the upper end of the channel CH11, and extends in the second cross direction D3 inside the connector 10. Thus, the third pilot oil passage PA13 is bent inside the connector 10. The channel CH11 may be referred to as a third segment. The channel CH12 may be referred to as a ninth segment.

Figure 13:
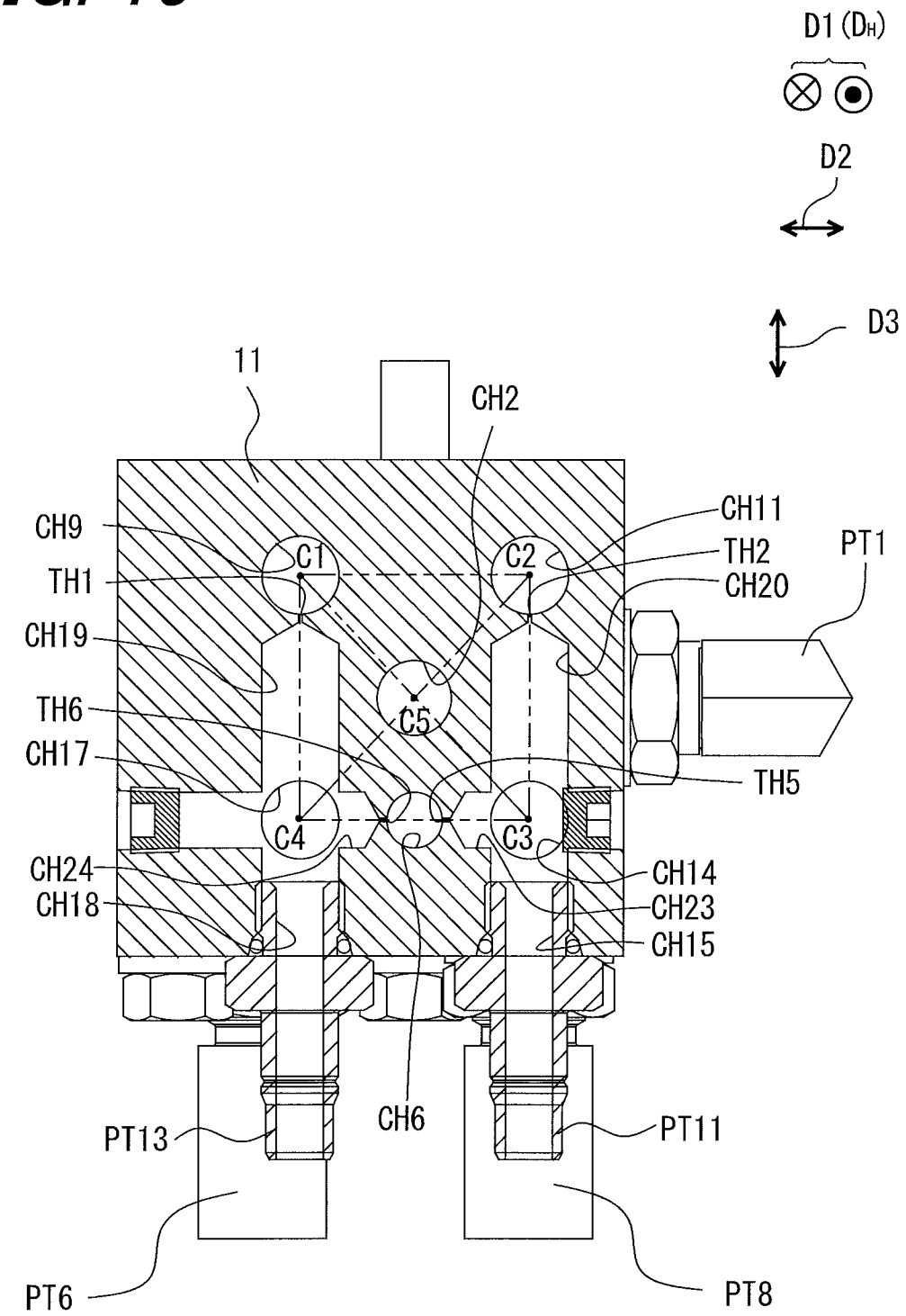
FIG. 13 is a cross-sectional view taken along line XIII-XIII' of FIGS. 4 to 6.

FIG. 13 is a cross-sectional view taken along line XIII-XIII' of FIGS. 4 to 6. Referring to FIGS. 6, 11, and 13, the connector 10 includes channels CH13, CH14, and CH15 that form a second pilot oil passage PA12. In FIG. 6, the channels CH13, CH14, and CH15 are indicated by dotted lines. The channel CH14 extends in the longitudinal direction D1 inside the connector 10. The channel CH13 connects the port PT10 and the channel CH14 and extends in the second cross direction D3 inside the connector 10. The channel CH15 connects the port PT11 and the upper end of the channel CH14, and extends in the second cross direction D3 inside the connector 10. Thus, the second pilot oil passage PA12 is bent inside the connector 10. The channel CH14 may be referred to as a second segment. The channel CH15 may be referred to as an eighth segment. Referring to FIGS. 5, 11, and 13, the connector 10 includes channels CH16, CH17, and CH18 that form a first pilot oil passage PA11. In FIG. 5, the channels CH16, CH17, CH18 are indicated by dotted lines. The channel CH17 extends in the longitudinal direction D1 inside the connector 10. The channel CH16 connects the port PT12 and the channel CH17 and extends in the second cross direction D3 inside the connector 10. The channel CH18 connects the port PT13 and the upper end of the channel CH17, and extends in the second cross direction D3 inside the connector 10. Thus, the first pilot oil passage PA11 is bent inside the connector 10. The channel CH17 may be referred to as a first segment. The channel CH18 may be referred to as a seventh segment.

Referring to FIGS. 5 and 13, the connector 10 includes a channel CH19 that forms a first bypass oil passage B1. The channel CH19 is connected to the channels CH17 and CH18 and extends from the channel CH18 (seventh segment) in the second cross direction D3. The center line of the channel CH19 is coaxial with the center line of the channel CH18. A first throttle TH1 connected to the channel CH9 is connected to an end of the channel CH19 (an end opposite to an end connected to the channel CH18 in the second cross section D3 among two ends of the channel CH19). That is, the connector 10 includes the first throttle TH1 that connects the channel CH9 and the channel CH18. The first throttle TH1 is a small-diameter hole formed in the connector 10. However, the first throttle TH1 may not be formed by boring a metallic member, and a general-purpose orifice may be inserted therein.

Referring to FIGS. 6 and 13, the connector 10 includes a channel CH20 that forms a second bypass oil passage B2. The channel CH20 is connected to the channels CH14 and CH15 and extends from the channel CH15 (eighth segment) in the second cross direction D3. The center line of the channel CH20 is coaxial with the center line of the channel CH15. A second throttle TH2 connected to the channel CH11 is connected to an end of the channel CH20 (an end opposite to an end connected to the channel CH15 in the second cross direction D3 among two ends of the channel CH20). That is, the connector 10 includes the second throttle TH2 that connects the channel CH11 and the channel CH20. The second throttle TH2 is a small-diameter hole formed in the connector 10. However, the second throttle TH2 may not be formed by boring a metallic member, and a general-purpose orifice may be inserted therein.

Referring to FIGS. 11 to 13, the connector 10 includes channels CH21 to CH24 that respectively form a third bypass oil passage B3 to a sixth bypass oil passage B6. The channel CH21, which forms the sixth bypass oil passage B6, is connected to the channel CH9 (fourth segment) via the channel CH10 (tenth segment), and extends in the first cross direction D2 inside the connector 10. The channel CH22, which forms the fifth bypass oil passage B5, is connected to the channel CH11 (third segment) via the channel CH12 (ninth segment), and extends in the first cross direction D2 inside the connector 10. The channel CH23, which forms the fourth bypass oil passage B4, is connected to the channel CH14 (second segment) via the channel CH15 (eighth segment), and extends in the first cross direction D2 inside the connector 10. The channel CH24, which forms the third bypass oil passage B3, is connected to the channel CH17 (first segment) via the channel CH18 (seventh segment), and extends in the first cross direction D2 inside the connector 10. Furthermore, the connector 10 includes a sixth throttle TH6 that connects the channel CH6 and the channel CH21, a fifth throttle TH5 that connects the channel CH6 and the channel CH22, a fourth throttle TH4 that connects the channel CH6 and the channel CH23, and a third throttle TH3 that connects the channel CH6 and the channel CH24. Each of the third throttle TH3 to the sixth throttle TH6 is a small-diameter hole formed in the connector 10. However, at least one of the third throttle TH3 to the sixth throttle TH6 may not be formed by boring a metallic member, and a general-purpose orifice may be inserted therein.

Referring to FIGS. 7, 9, 12, and 13, a channel CH2 (fifth segment), which is a part of the warm-up oil passage PA8, is surrounded by channels CH9 to 12, CH14, CH17, CH19, and CH20 that form or communicate with the first pilot oil passage PA11 to the fourth pilot oil passage PA14. That is, the warm-up oil passage PA8 is surrounded by the first pilot oil passage PA11, the second pilot oil passage PA12, the third pilot oil passage PA13, and the fourth pilot oil passage PA14 inside the connector 10. Specifically, as shown in FIG. 13, when viewed in the longitudinal direction D1, the channel CH2 (fifth segment) is located inside a quadrangle C1C2C3C4 defined by the center C4 of the channel CH9 (fourth segment), the center C3 of the channel CH11 (third segment), the center C2 of the channel CH14 (second segment), and the center C1 of the channel CH17 (first segment). To be more specific, the quadrangle C1C2C3C4 is a rectangle, and the center C5 of the channel CH2 (fifth segment) substantially coincides with an intersection of diagonal lines of the rectangle. Therefore, heat exchange can be efficiently performed between the warm-up oil passages PA8 and PA9 and the first pilot oil passage PA11 to the fourth pilot oil passage PA14.

Advantageous Effect of the Embodiment

In the present embodiment, the work vehicle 1 includes a vehicle body 2, a first travel device 3L, a second travel device 3R, a first hydraulic motor 31L, a second hydraulic motor 31R, a first hydraulic pump 7L, a second hydraulic pump 7R, and an operation device 56. The work vehicle 1 further includes a first pilot oil passage PA11, a second pilot oil passage PA12, a third pilot oil passage PA13, a fourth pilot oil passage PA14, a first bypass oil passage B1, a second bypass oil passage B2, a first throttle TH1, and a second throttle TH2. The first pilot oil passage PA11 connects the operation device 56 and the first port PLa of the first hydraulic pump 7L. The second pilot oil passage PA12 connects the operation device 56 and the second port PLb of the first hydraulic pump 7L. The third pilot oil passage PA13 connects the operation device 56 and the third port PRa of the second hydraulic pump 7R. The fourth pilot oil passage PA14 connects the operation device 56 and the fourth port PRb of the second hydraulic pump 7R. The first bypass oil passage B1 connects the first pilot oil passage PA11 and the fourth pilot oil passage PA14. The second bypass oil passage B2 connects the second pilot oil passage PA12 and the third pilot oil passage PA13. The first throttle TH1 is provided in the first bypass oil passage B1. The second throttle TH2 is provided in the second bypass oil passage B2.

The first bypass oil passage B1 and the first throttle TH1 allow the oil to escape from the first pilot oil passage PA11 to the fourth pilot oil passage PA14 when the right pivot turn is to be performed from forward movement. Therefore, the pilot pressure of the fourth port PRb of the second hydraulic pump 7R is increased, so that the operability of shifting to the right pivot turn is improved. The second bypass oil passage B2 and the second throttle TH2 allow the oil to escape from the third pilot oil passage PA13 to the first pilot oil passage PA11 when the left pivot turn is to be performed from forward movement. Therefore, the pilot pressure of the second port PLb of the first hydraulic pump 7L is increased, so that the operability of shifting to the left pivot turn is improved.

Variations of the Embodiment

In the above-described embodiment, the channels forming the first pilot oil passage PA11 in the connector 10 and the channels forming the fourth pilot oil passage PA14 in the connector 10 may be switched, and the channel forming the second pilot oil passage PA12 in the connector 10 and the channel forming the third pilot oil passage PA13 in the connector 10 may be switched. Further, the combination of the channel forming the first pilot oil passage PA11 in the connector 10 and the channel forming the fourth pilot oil passage PA14 in the connector 10 may be replaced with the combination of the channels forming the second pilot oil passage PA12 in the connector 10 and the channel forming the third pilot oil passage PA13 in the connector 10.

In this application, "comprising" and its derivatives are open-ended terms that describe the presence of elements and do not exclude the presence of other elements not described. This also applies to "having", "including" and derivatives thereof.

The terms " . . . member", ". . . part", " . . . element", " . . . body" and ". . . structure" may have multiple meanings, such as a single part or multiple parts.

Ordinal numbers such as "first" and "second" are merely terms for identifying configurations, and do not have other meanings (for example, a specific order). For example, the presence of a "first element" does not imply that a "second element" is present, and the presence of a "second element" does not imply that a "first element" is present.

Terms such as "substantially", "about", and "approximately" indicating the degree may mean a reasonable amount of deviation such that the final result is not significantly changed unless otherwise specified in the embodiments. All numerical values recited in this application can be construed to include language such as "substantially," "about," and "approximately."

The phrase "at least one of A and B" in this application should be interpreted to include only A, only B, and both A and B.

Obviously, many modifications and variations of the present invention are possible in light of the above teachings. Accordingly, the invention may be practiced otherwise than as specifically disclosed herein without departing from the spirit of the invention.

What is claimed is:

1. A work vehicle comprising:

a vehicle body having a first side surface and a second side surface opposite to the first side surface;

a first travel device provided on the first side surface of the vehicle body;

a second travel device provided on the second side surface of the vehicle body;

a first hydraulic motor to drive the first travel device;

a second hydraulic motor to drive the second travel device;

a first hydraulic pump connected to the first hydraulic motor via a first hydraulic circuit and having a first port and a second port, the first hydraulic pump being configured:

to supply hydraulic oil to the first hydraulic motor via the first hydraulic circuit to drive the first travel device forward when hydraulic pressure applied to the first port is higher than hydraulic pressure applied to the second port; and to supply hydraulic oil to the first hydraulic motor via the first hydraulic circuit to drive the first travel device backward when hydraulic pressure applied to the second port is higher than hydraulic pressure applied to the first port;

a second hydraulic pump connected to the second hydraulic motor via a second hydraulic circuit and having a third port and a fourth port, the second hydraulic pump being configured:

to supply hydraulic oil to the second hydraulic motor via the second hydraulic circuit to drive the second travel device forward when hydraulic pressure applied to the third port is higher than hydraulic pressure applied to the fourth port; and to supply hydraulic oil to the second hydraulic motor via the second hydraulic circuit to drive the second travel device backward when hydraulic pressure applied to the fourth port is higher than hydraulic pressure applied to the third port;

an operation device configured to select at least one travel device out of the first travel device and the second travel device and to operate forward or backward movement of the at least one travel device;

a first pilot oil passage connecting the operation device and the first port;

a second pilot oil passage connecting the operation device and the second port;

a third pilot oil passage connecting the operation device and the third port;

a fourth pilot oil passage connecting the operation device and the fourth port;

a first bypass oil passage connecting the first pilot oil passage and the fourth pilot oil passage;

a second bypass oil passage connecting the second pilot oil passage and the third pilot oil passage;

a first throttle provided in the first bypass oil passage;

a second throttle provided in the second bypass oil passage; and a connector through which the first pilot oil passage, the second pilot oil passage, the third pilot oil passage, and the fourth pilot oil passage pass.

2. The work vehicle according to claim 1, wherein the first bypass oil passage and the second bypass oil passage are provided inside the connector.

3. The work vehicle according to claim 2, wherein the first throttle and the second throttle are provided inside the connector.

4. The work vehicle according to claim 1, wherein a warm-up oil passage surrounded by the first pilot oil passage, the second pilot oil passage, the third pilot oil passage, and the fourth pilot oil passage inside the connector.

5. The work vehicle according to claim 4, wherein the connector extends in a longitudinal direction, wherein the first pilot oil passage includes a first segment extending in the longitudinal direction inside the connector, wherein the second pilot oil passage includes a second segment extending in the longitudinal direction inside the connector, wherein the third pilot oil passage includes a third segment extending in the longitudinal direction inside the connector, wherein the fourth pilot oil passage includes a fourth segment extending in the longitudinal direction inside the connector, wherein the warm-up oil passage includes a fifth segment extending in the longitudinal direction inside the connector, and wherein, when viewed in the longitudinal direction, the fifth segment is located inside a quadrangle defined by a center of the first segment, a center of the second segment, a center of the third segment, and a center of the fourth segment.

6. The work vehicle according to claim 4, further comprising:

a drain oil passage including a sixth segment extending in the longitudinal direction inside the connector;

a third bypass oil passage connected to the first segment and extending in a first cross direction perpendicular to the longitudinal direction inside the connector;

a fourth bypass oil passage connected to the second segment and extending in the first cross direction inside the connector;

a fifth bypass oil passage connected to the third segment and extending in the first cross direction inside the connector;

a sixth bypass oil passage connected to the fourth segment and extending in the first cross direction inside the connector;

a third throttle provided in the third bypass oil passage;

a fourth throttle provided in the fourth bypass oil passage;

a fifth throttle provided in the fifth bypass oil passage; and a sixth throttle provided in the sixth bypass oil passage, wherein the longitudinal direction is substantially parallel to a height direction along a height of the work vehicle, and wherein the connector includes an air vent hole connected to an upper end of the sixth segment.

7. The work vehicle according to claim 6, wherein at least one of the first pilot oil passage and the fourth pilot oil passage is bent inside the connector, and wherein at least one of the second pilot oil passage and the third pilot oil passage is bent inside the connector.

8. The work vehicle according to claim 7, wherein the first pilot oil passage includes a seventh segment extending in a second cross direction perpendicular to the longitudinal direction and the first cross direction inside the connector, wherein the second pilot oil passage includes an eighth segment extending in the second cross direction inside the connector, wherein the third pilot oil passage includes a ninth segment extending in the second cross direction inside the connector, and wherein the fourth pilot oil passage includes a tenth segment extending in the second cross direction inside the connector.

9. The work vehicle according to claim 8, wherein the first bypass oil passage extends from the tenth segment in the second cross direction, and wherein the second bypass oil passage extends from the ninth segment in the second cross direction.

10. The work vehicle according to claim 1, wherein the connector is made of a metal material.

11. A work vehicle comprising:

a vehicle body having a first side surface and a second side surface opposite to the first side surface;

a first travel device provided on the first side surface of the vehicle body;

a second travel device provided on the second side surface of the vehicle body;

a first hydraulic motor to drive the first travel device;

a second hydraulic motor to drive the second travel device;

a first hydraulic pump connected to the first hydraulic motor via a first hydraulic circuit and having a first port and a second port, the first hydraulic pump being configured:

to supply hydraulic oil to the first hydraulic motor via the first hydraulic circuit to drive the first travel device forward when hydraulic pressure applied to the first port is higher than hydraulic pressure applied to the second port; and to supply hydraulic oil to the first hydraulic motor via the first hydraulic circuit to drive the first travel device backward when hydraulic pressure applied to the second port is higher than hydraulic pressure applied to the first port;

a second hydraulic pump connected to the second hydraulic motor via a second hydraulic circuit and having a third port and a fourth port, the second hydraulic pump being configured:

to supply hydraulic oil to the second hydraulic motor via the second hydraulic circuit to drive the second travel device forward when hydraulic pressure applied to the third port is higher than hydraulic pressure applied to the fourth port; and to supply hydraulic oil to the second hydraulic motor via the second hydraulic circuit to drive the second travel device backward when hydraulic pressure applied to the fourth port is higher than hydraulic pressure applied to the third port;

an operation device configured to select at least one travel device out of the first travel device and the second travel device and to operate forward or backward movement of the at least one travel device;

a first pilot oil passage connecting the operation device and the first port;

a second pilot oil passage connecting the operation device and the second port;

a third pilot oil passage connecting the operation device and the third port;

a fourth pilot oil passage connecting the operation device and the fourth port;

a connector through which the first, second, third, and fourth pilot oil passages pass and which extends in a longitudinal direction;

a warm-up oil passage surrounded by the first pilot oil passage, the second pilot oil passage, the third pilot oil passage, and the fourth pilot oil passage inside the connector, wherein the first pilot oil passage includes a first segment extending in the longitudinal direction inside the connector, wherein the second pilot oil passage includes a second segment extending in the longitudinal direction inside the connector, wherein the third pilot oil passage includes a third segment extending in the longitudinal direction inside the connector, wherein the fourth pilot oil passage includes a fourth segment extending in the longitudinal direction inside the connector, wherein the warm-up oil passage includes a fifth segment extending in the longitudinal direction inside the connector, and wherein when viewed in the longitudinal direction, the fifth segment is located inside a quadrangle defined by a center of the first segment, a center of the second segment, a center of the third segment, and a center of the fourth segment.

* * * * *